US005689756A

United States Patent [19]

Taki et al.

[11] Patent Number: 5,689,756

[45] Date of Patent: Nov. 18, 1997

[54] ROTATION ABNORMALITY DETECTING DEVICE FOR USE IN IMAGE FORMING APPARATUS

[75] Inventors: Kenji Taki; Takao Kurohata; Yasuhiko Yamaguchi; Chiharu Kobayashi; Kiyoshi Kimura, all of Hachioji, Japan

[73] Assignee: Konica Corporation, Japan

[21] Appl. No.: 504,483

[22] Filed: Jul. 20, 1995

[30] Foreign Application Priority Data

Jul. 25, 1994 [JP] Japan ..... 6-172551

[51] Int. Cl.[6] ..... G03G 15/20

[52] U.S. Cl. ..... 399/33; 399/36

[58] Field of Search ..... 355/208, 246, 355/206; 399/33, 36, 67

[56] References Cited

U.S. PATENT DOCUMENTS

| | | | |
|---|---|---|---|
| 4,365,888 | 12/1982 | Hosaka et al. | 355/208 |
| 4,577,953 | 3/1986 | Narukawa | 355/208 |
| 4,748,555 | 5/1988 | Miyake et al. | 355/208 X |
| 5,049,938 | 9/1991 | Ueda | 355/246 |
| 5,225,870 | 7/1993 | Tanimoto et al. | 355/200 |
| 5,455,656 | 10/1995 | Covert et al. | 355/208 X |

FOREIGN PATENT DOCUMENTS

| | | |
|---|---|---|
| 6-51637 | 2/1994 | Japan . |
| 6-067526 | 3/1994 | Japan . |

*Primary Examiner*—Nestor R. Ramirez

*Attorney, Agent, or Firm*—Jordan B. Bierman; Bierman, Muserlian and Lucas LLP

[57] ABSTRACT

An image forming apparatus includes a process unit provided detachably attachable to the apparatus; a driving source provided inside the apparatus and outside the process unit; a power transmitter to transmit a driving force from the driving source; a rotary member provided inside the process unit, the rotary member being rotated by the driving force from the driving source transmitted through the power transmitter. The apparatus further includes a detector to detect a state of rotation of the rotary member, and to output a signal corresponding to the state of rotation of the rotary member; and a judging member to judge a rotation abnormality of the rotary member on the basis of the signal output from the detector.

16 Claims, 15 Drawing Sheets

ROTATION ABNORMALITY DETECTING DEVICE FOR USE IN IMAGE FORMING APPARATUS

BACKGROUND OF THE INVENTION

The present invention relates to a rotation-abnormality-detecting device used for an image forming apparatus, and more particularly, to a device which can detect occurrence of rotation abnormality of a rotary member which can be mounted on and dismounted from a main body of the image forming apparatus and is driven from the side of the main body of the image forming apparatus, the rotation abnormality being caused by improper mounting of a process unit that is equipped with the rotary member.

In some of electrophotographic image forming apparatuses, a developing unit, a drum unit, a fixing unit and a transfer conveyance unit are structured to be capable of being mounted on and dismounted from a main body of the apparatus for the purpose of increasing easiness of work for maintenance, inspection and cleaning of each unit and the main body of the apparatus.

When each unit is structured to be capable of being mounted on and dismounted from the main body as stated above, rotary members of the units, namely, a stirring member in a developing unit, a photoreceptor drum of a drum unit, a pressure roller of a fixing unit and a conveyance belt of a transfer and conveyance unit are structured to be driven by motors provided in the main body. For example, driving force from the side of the main body is engaged with a driven gear on the unit (Japanese Patent Publication Open to Public Inspection No. 51637/1994 (hereinafter referred to as Japanese Patent O.P.I Publication)).

As stated above, when a unit equipped with a rotary member is mounted, it is necessary that driving parts on the main body are engaged with those on the unit properly. However, there has been an anxiety that an apparatus is operated without noticing that the engagement is not proper or foreign materials are caught in the engagement section by the driving parts, or an apparatus is operated with a defective unit containing foreign materials affecting the rotation of rotating members adversely mounted on the apparatus erroneously. This has sometimes caused damage, wear and deformation of driving parts such as gears or damage of a driving motor caused by an excessive load applied on the driving sections.

Heretofore, on a main body, rotating speed of a driving motor has been controlled, or the motor has been stopped by detecting abnormality of the rotating speed of the motor, while on a unit, there have been detected data of various characteristics such as toner concentration, toner level, electric current abnormality of transfer unit, electric current abnormality of a corona electrode of a drum unit, abnormality in mounting each unit, abnormality of fixing temperature, voltage of a photoreceptor, winding around a drum, and image density on the drum.

However, even when the abnormality is not detected by those mentioned above, there have been improper engagement between driving parts on the unit and those on the main body and mechanical abnormality such as invasion of foreign materials into the unit. Therefore, there has been a fear that an apparatus is operated without noticing such mechanical abnormality and parts are damaged accordingly.

SUMMARY OF THE INVENTION

The first object of the invention achieved for solving the aforesaid problems is to provide a detecting device capable of detecting occurrence of improper engagement between a driving section on a detachable process unit and that on a main body, and detecting mechanical abnormality of the driving system of rotating members in the unit such as invasion of foreign materials into the unit, and thereby to avoid occurrence of damage of driving parts and a motor.

The second object of the invention is to make it possible to detect occurrence of the aforesaid mechanical abnormality with a simple constitution without necessity of providing an exclusive sensor.

Therefore, a rotation-abnormality-detecting device of an image forming apparatus in the first embodiment of the invention is constituted to include a process unit that is capable of being mounted on or dismounted from the main body and is equipped with rotary members driven from the main body side, a rotation-detecting means that detects the state of rotation of the aforesaid rotary members of the process unit, and a rotation-abnormality-discriminating means that discriminates rotation abnormality of the aforesaid rotary members based on the state of rotation detected by the rotation-detecting means.

The rotation-abnormality-detecting device in the second embodiment of the invention is constituted to be provided with a rotation-driving-stopping means that stops the main body from driving at least the rotary member on which occurrence of rotation abnormality was discriminated when occurrence of rotation abnormality is detected by the rotation-abnormality-discriminating means.

The rotation-abnormality-detecting device in the third embodiment of the invention is constituted to be provided with an abnormality-indicating means that indicates at least one of occurrence of the aforementioned rotation abnormality and predetermined indication for the aforementioned occurrence of rotation abnormality, when occurrence of rotation abnormality is discriminated by the rotation-abnormality-discriminating means.

The rotation-abnormality-detecting device in the fourth embodiment of the invention is constituted so that the process unit mentioned above is a developing unit containing two-component developer consisting of toner and carrier, the rotary member is a stirring member that stirs and mixes the two-component developer, the rotation-detecting means reads detection signals which are from a toner concentration sensor that detects toner concentration in the developing unit as a parameter showing the state of rotation of the stirring member, and the rotation-abnormality-discriminating means discriminates rotation abnormality of the stirring member based on fluctuation of the toner concentration.

The rotation-abnormality-detecting device in the fifth embodiment of the invention is constituted so that occurrence of rotation abnormality of the stirring member is discriminated by the aforementioned rotation-abnormality-discriminating means when the fluctuation range of toner concentration in a prescribed period of time is not more than the prescribed value in the rotation abnormality discrimination of the stirring member based on fluctuation of toner concentration in the fourth embodiment of the invention.

The rotation-abnormality-detecting device in the sixth embodiment of the invention is constituted so that occurrence of rotation abnormality of the stirring member is discriminated by the aforementioned rotation-abnormality-discriminating means when a cycle of fluctuation of toner concentration is out of the prescribed range in the rotation abnormality discrimination of the stirring member based on fluctuation of toner concentration in the fourth embodiment of the invention.

The rotation-abnormality-detecting device in the seventh embodiment of the invention is constituted so that the process unit is a fixing unit equipped with at least a pair of pressure rollers as a rotary member, the rotation-detecting means reads the fixing temperature in the fixing unit as a parameter showing the state of rotation of the pressure rollers, and the rotation-abnormality-discriminating means discriminates the rotation abnormality of the pressure rollers based on the fixing temperature mentioned above.

The rotation-abnormality-detecting device in the eighth embodiment of the invention is constituted so that occurrence of rotation abnormality of the pressure rollers is discriminated by the rotation-abnormality-discriminating means when the fluctuation range of fixing temperature within a prescribed period of time from the start of driving the pressure rollers is not more than the predetermined value in the discrimination of rotation abnormality of the pressure roller made based on the fixing temperature mentioned above.

The rotation-abnormality-detecting device in the ninth embodiment of the invention is constituted so that the rotation-detecting means detects the rotation of the rotary member of the process unit and detects also whether the process unit is mounted or not.

The rotation-abnormality-detecting device in the tenth embodiment of the invention is constituted so that the rotation-detecting means is composed of a reflection section that is provided around the external circumferential portion of the rotary member in the direction of its rotation and has varying reflectance and of a optics sensor consisting of a light-emitting element and a light-receiving element and detects the rotation of the rotary member based on the change in the intensity of light reflected on the reflection section detected by the optics sensor, and whether the process unit is mounted or not is detected by the existence of the reflected light.

The rotation-abnormality-detecting device in the eleventh embodiment of the invention is constituted so that the process unit is at least one of a drum unit and a transfer conveyance unit and the reflection section is provided at the side edge portion of a photoreceptor drum as s rotary member or of a conveyance belt, in the case where the rotation-detecting means is composed of the reflection section and the optics sensor in the tenth embodiment of the invention.

The rotation-abnormality-detecting device in the first embodiment of the invention detects the state of rotation of the rotary member provided on the process unit, in an image forming apparatus constituted to include the process unit equipped with a rotary member capable of being mounted on and dismounted from the main body and driven therefrom, and detects, based on the detected state of rotation, the state that the rotary member is not driven to rotate properly being caused by rotation abnormality of the rotary member, namely, mechanical abnormality such as improper engagement of driving parts and foreign matters caught therein, and further invasion of foreign matters into the unit.

In the rotation-abnormality-detecting device in the second embodiment of the invention prevents, through suspension of driving by the main body for the rotary member discriminated to suffer occurrence of rotation abnormality, it is prevented that the apparatus is operated under occurrence of mechanical abnormality such as improper engagement of driving parts, foreign matters caught in the engagement or invasion of foreign matters into the unit, and the driving parts are damaged accordingly.

In the rotation-abnormality-detecting device in the third embodiment of the invention, when occurrence of rotation abnormality is discriminated, the occurrence of rotation abnormality is indicated, or the instruction relating to the occurrence of rotation abnormality (e.g., Inspect whether the process unit suffering occurrence of rotation abnormality is mounted or not.) is indicated, and the user is warned of the occurrence of mechanical abnormality, being urged to take an appropriate measure.

In the rotation-abnormality-detecting device in the fourth embodiment of the invention, rotation abnormality of the stirring member serving as a rotary member provided to stir and mix a two-component developer composed of toner and carrier is detected in a developing unit serving as the process unit. In this case, since the stirring member mentioned above is provided for the purpose of stirring and mixing toner and carrier, when the stirring member is driven to rotate properly, predetermined concentration fluctuation is indicated as the stirring member rotates. Therefore, it is possible to discriminate occurrence of rotation abnormality of the stirring member by watching whether the toner concentration fluctuation shows the characteristics in the normal occasion or not.

In the rotation-abnormality-detecting device in the fifth embodiment of the invention, when the fluctuation range of toner concentration within a prescribed period of time is not more than the predetermined value, it is assumed that the expected fluctuation is not caused in the detected value of toner concentration, because the stirring member is suspended or it is rotating at the speed lower than the normal speed.

In the rotation-abnormality-detecting device in the sixth embodiment of the invention, when the fluctuation cycle of the toner concentration is out of a predetermined range, it is assumed that the stirring member is suspended or it is rotating at the speed lower than the normal speed. Namely, since the fluctuation cycle of the toner concentration corresponds mostly to the rotating speed of the stirring member, if the fluctuation cycle of concentration shows one which can not be taken when the stirring member is driven to rotate at the normal rotating speed, it is assumed that the stirring member is not driven normally due to some mechanical abnormality or other.

In the rotation-abnormality-detecting device in the seventh embodiment of the invention, rotation abnormality of the pressure roller as a rotary member is detected based on the fixing temperature, in the fixing unit as a process unit. Namely, it is actually detected whether the pressure roller is rotated normally or not, utilizing the fact that the fixing temperature (temperature on the pressure roller) fluctuates, being influenced by rotation and suspension of the pressure roller.

In the rotation-abnormality-detecting device in the eighth embodiment of the invention, when the fluctuation range of the fixing temperature within a period from the moment when the pressure roller is suspended to the moment after the start of driving the pressure roller is not more than the predetermined value, it is assumed that the fluctuation of the fixing temperature is small, because the pressure roller is not rotating actually despite driving from the main body. The rotation-abnormality-detecting device in the ninth embodiment of the invention is constituted so that the rotation-detecting means can detect rotation of a rotary member on the process unit and detect whether the process unit is mounted or not. Namely, in the constitution, rotation detection for detecting abnormal rotation is conducted by utilizing the series of sensors provided for detecting the mounting.

In the rotation-abnormality-detecting device in the tenth embodiment of the invention, it is possible to detect rotation of the rotary member and to detect whether the process unit is mounted on the main body or not, by detecting the reflectance of the reflection section provided on the rotary member of the process unit with the sensor on the main body.

The rotation-abnormality-detecting device in the eleventh embodiment of the invention is constituted so that the reflection section is provided either on a photoreceptor drum of the drum unit or on the conveyance belt for a transfer conveyance unit for achieving that whether the drum unit or the transfer conveyance unit is mounted on the main body or not, and rotation abnormality of the photoreceptor drum or of the conveyance belt is detected.

DETAILED DESCRIPTION OF THE PREFERRED EMBODIMENT

Figure 1:
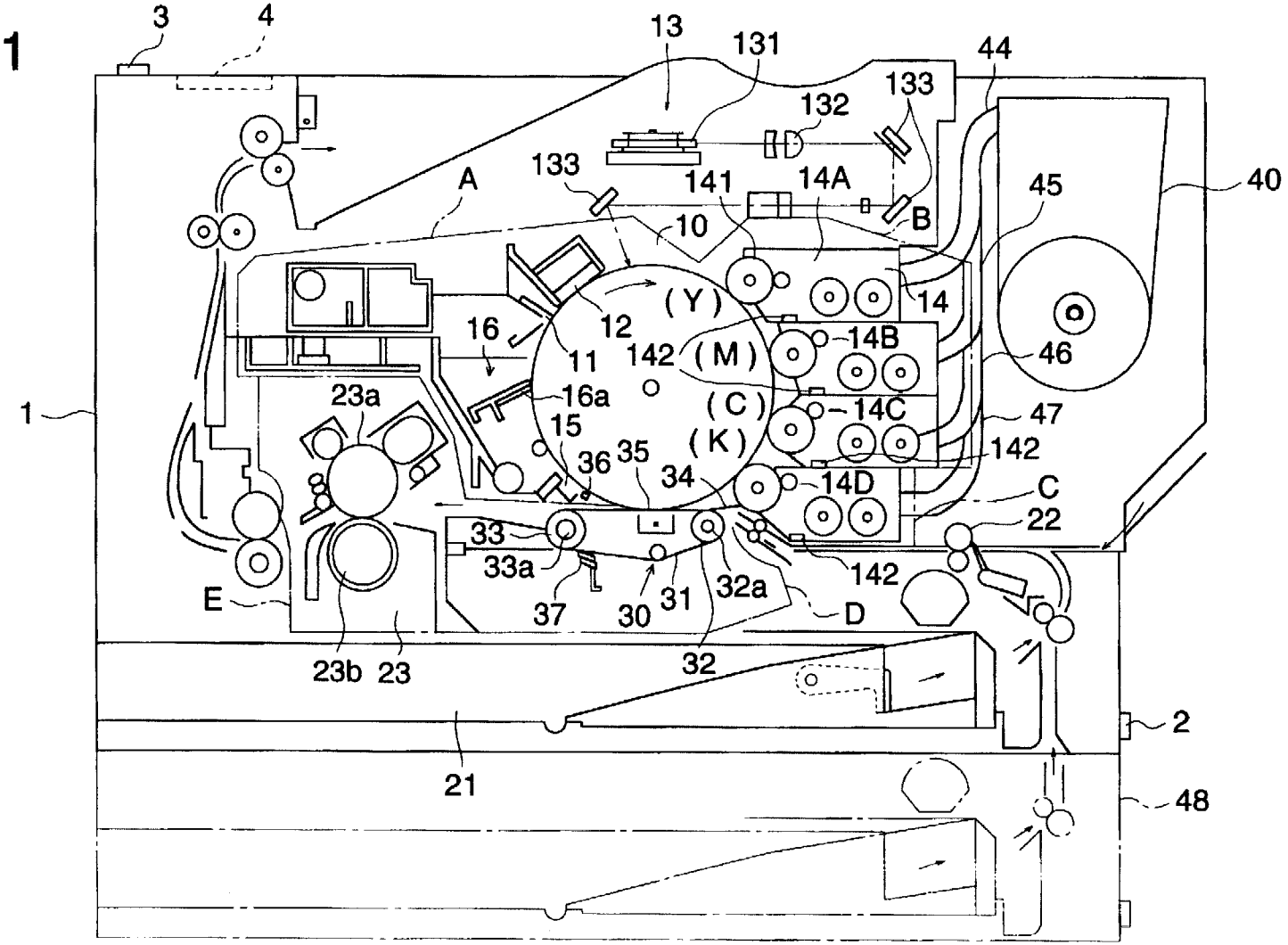
FIG. 1 is a sectional view showing how the laser color printer of the example is structured.

Examples of the invention will be explained as follows, referring to the drawings.

FIG. 1 shows constitution of a laser color printer which is an example of an image forming apparatus related to the invention.

In the explanation of the outline of the constitution and operation, photoreceptor drum 10 whose surface is coated with an OPC light-sensitive layer is driven to rotate in one-way direction (clockwise in the figure) to be neutralized by neutralizing unit 11 from electric charges given in the preceding printing and to be charged uniformly by charging unit 12 so that the photoreceptor drum may be prepared for the succeeding printing.

After such uniform charging is made, imagewise exposure is given to the photoreceptor drum by imagewise exposure means 13 based on image signals. In the imagewise exposure means 13, a laser beam emitted from an unillustrated laser light source is guided to polygon mirror 131 for rotary scanning, then is deflected by reflection mirror 133 through fθ lens 132 and others, and is projected on the circumferential surface of the photoreceptor drum 10 which is charged in advance so that a latent image is formed on the drum surface.

Around the photoreceptor drum 10, there are provided developing units 14 each being filled with developer composed of mixture agents containing carrier (magnetic substance) and each of toners (coatings) such as those in yellow (Y), magenta (M), cyan (C) and black (B).

Figure 2:
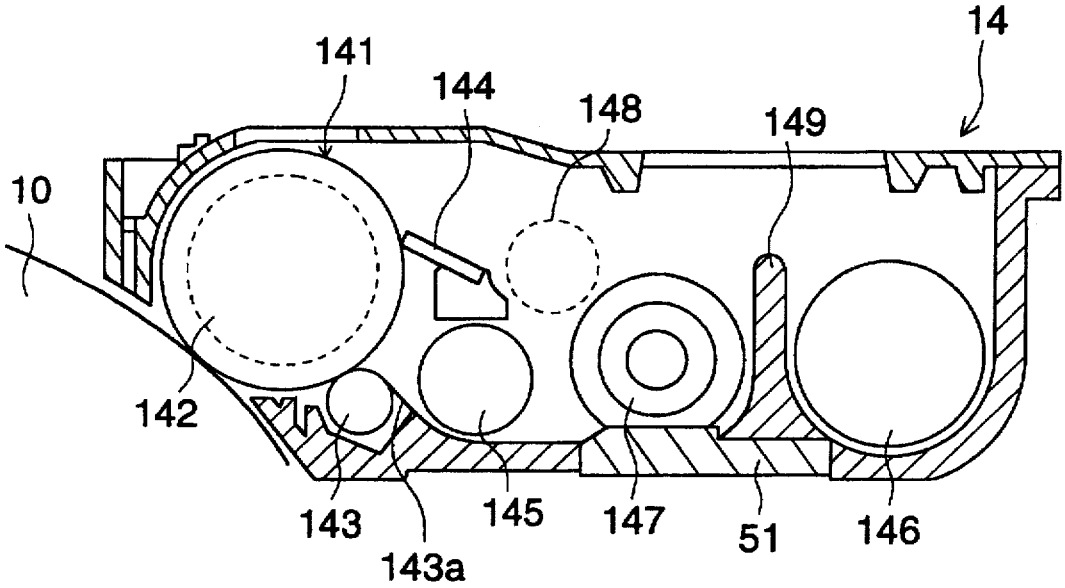
FIG. 2 is a section view showing how the developing unit is structured.

FIG. 2 is a sectional view showing an example of developing unit 14 containing the aforesaid two-component developer. In the unit, there are incorporated developing sleeve 141 wherein magnet roller 142 is housed, thin layer forming bar 143 that regulates the thickness of a developer layer attracted to the developing sleeve 141, scraper 144 that is a scraping member for removing used developer from the developing sleeve 141, supply roller 145 for supplying developer to the developing sleeve 141 and a pair of stirring screws (stirring members) 146 and 147 for stirring and mixing toner and carrier both for developer.

Figure 3:
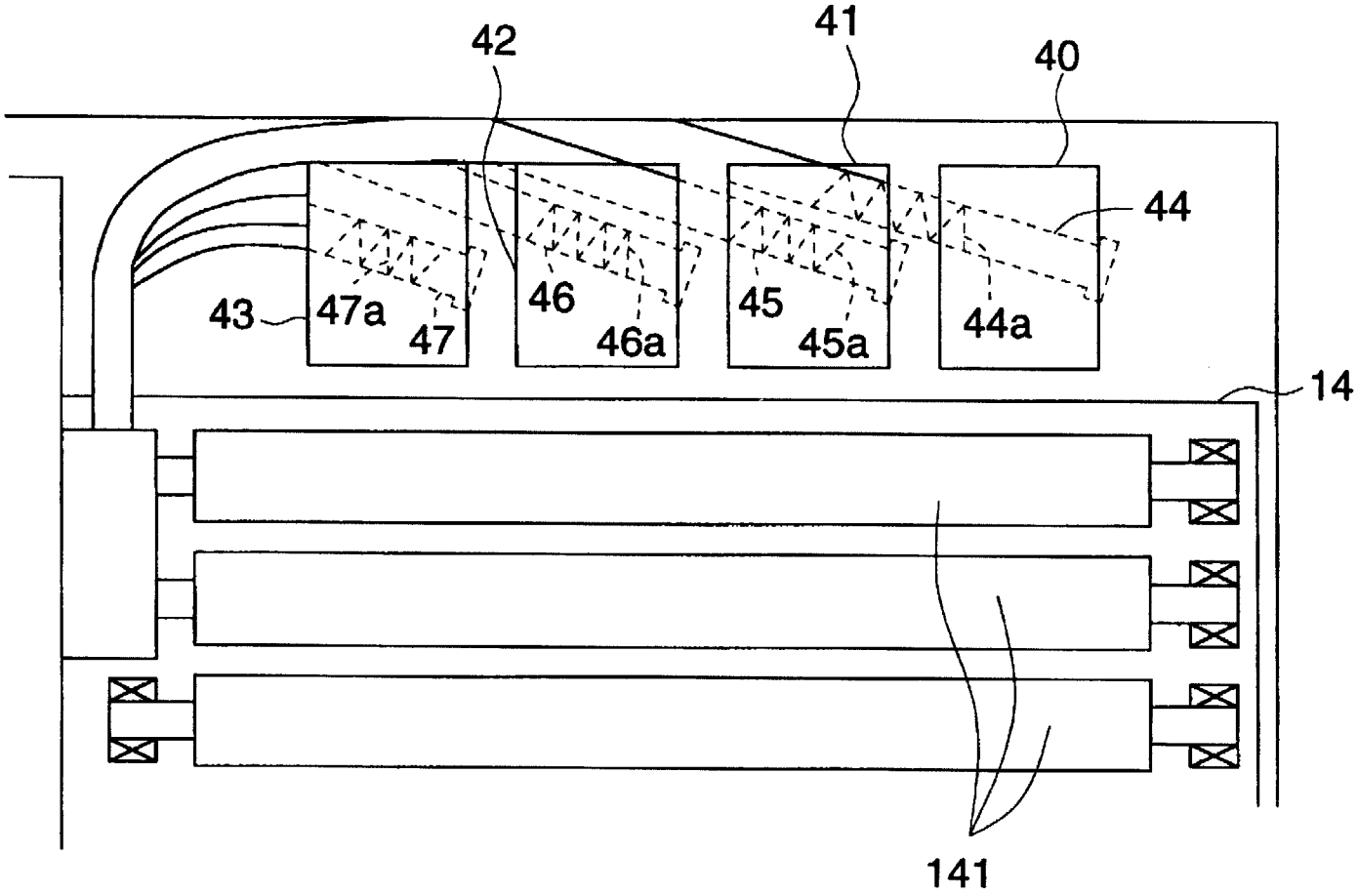
FIG. 3 is a section view showing the toner supply mechanism.

On the other hand, in order to supply each of yellow, magenta, cyan and black toners to each of developing units 14, there are provided hoppers 40–43 for supplying toners of respective colors, and conveyance pipes 44–47 for conveying toners in the hoppers 40–43 to the developing units 14 through rotation of screws 44*a*–47*a* incorporated therein, as shown in FIG. 3.

Toners supplied through the conveyance pipes 44–47 mentioned above fall at an end of stirring screw 147 on one side and are conveyed in the axial direction to arrive at an end of partition wall 149, and then are moved to an end of stirring screw 146 on the other side. In the course of being conveyed in the direction that is opposite to that of conveyance by means of the stirring screw 147, the toners are mixed evenly with contained developer to become a developer having a prescribed rate of toner component.

Then, the developer is conveyed to the circumferential surface of the developing sleeve 141 along PET sheet 143*a* that is brought into pressure-contact with thin layer forming bar 143 by friction force on the circumferential surface of the supply roller 145, then is held thereon by magnetic force of the magnet roller 142, and then is made to be a thin layer having a prescribed thickness by the thin layer forming bar 143 through its pressure-contact action, and the thin layer is conveyed to a developing zone on the photoreceptor drum 10.

The developer that has lost its toner component in the formation of toner images on the photoreceptor drum 10 in the developing zone is conveyed by the developing sleeve 141 rotating clockwise in the figure, and is removed from the circumferential surface of the developing sleeve 141 by scraper 144 that is in pressure-contact with the circumferential surface of the developing sleeve 141, then falls in the vicinity of the supply roller 145 to be mixed with new toner, and it is supplied again to the developing sleeve 141.

Incidentally, in constitution of developing unit 14 shown in FIG. 2, the constitution wherein stirring roller 148 showing with dotted lines in the figure is provided in addition to stirring screws 146 and 147 is also allowed.

On such developing unit 14, toner concentration sensor 51 wherein oscillation frequency varies depending on magnetic permeability of the developer, and thereby toner concentration is detected is provided to face upward below the stirring screw 147 with a clearance of 0–1 mm.

The toner concentration sensor 51 mentioned above is installed so that the developer may be guided into a coil of a resonance circuit to pass through it. An amount of carrier representing magnetic particles that flow through the magnetic field of the coil decreases when an amount of toner is larger, and it increases when an amount of toner is small, and inductance of the coil varies depending on the amount of carrier.

For detecting the change of inductance, namely of magnetic permeability with high sensitivity, it is arranged that magnetic permeability is taken as frequency change of resonance circuit ($f=\frac{1}{2\pi}(6C)^{1/2}$), frequency signals corresponding to concentration outputted from the sensor are shaped into pulse signals, frequency is detected by the number of occurrences of the pulse signals within a prescribed gate time, and toner concentration is detected based on the frequency (pulse number) and thereby toner supply is controlled so that toner concentration is constant during developing.

Figure 4:
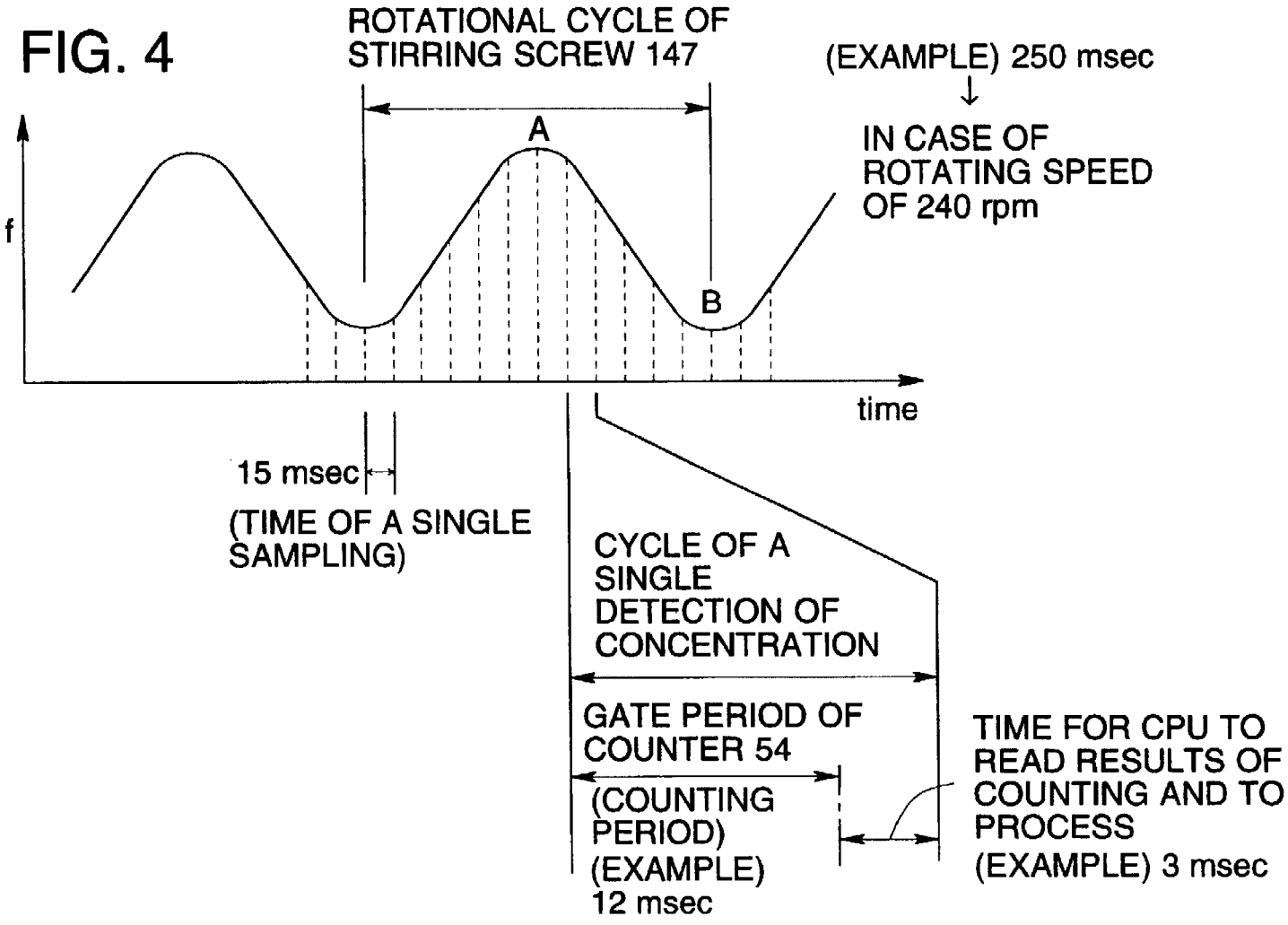
FIG. 4 is a time chart showing the output characteristics of a toner concentration sensor.

When the toner concentration sensor 51 is provided at the position mentioned above, an output (oscillation frequency) of the sensor 51 shows variation shown in FIG. 4 in accordance with action of stirring screw 147 located at the upper position.

Point A on the curve of concentration variation in FIG. 4 shows an output corresponding to the moment when the crest (gear) of the stirring screw 147 comes to the point right above the sensor 51, while, point B shows an output corresponding to the moment when the trough of the screw comes to the point right above the sensor 51. In an example shown in FIG. 4, the stirring screw is rotating at the rotating speed of 240 r.p.m., and the rotation cycle of the stirring screw 147 is 250 msec accordingly. CPU for detecting toner concentration detects toner concentration every 15 msec. Among 15 msec, 12 msec corresponds to a counting period and 3 msec is a data reading period. Detection of this type is repeated, and thereby toner concentration at point B is detected. Namely, within a period (e.g., 300 msec) longer than one rotation of the stirring screw 147, sampling of toner concentration detection is repeated at the cycle of 15 msec to process therein. Series of controls mentioned above are conducted through CPU command and internal processing.

Figure 5:
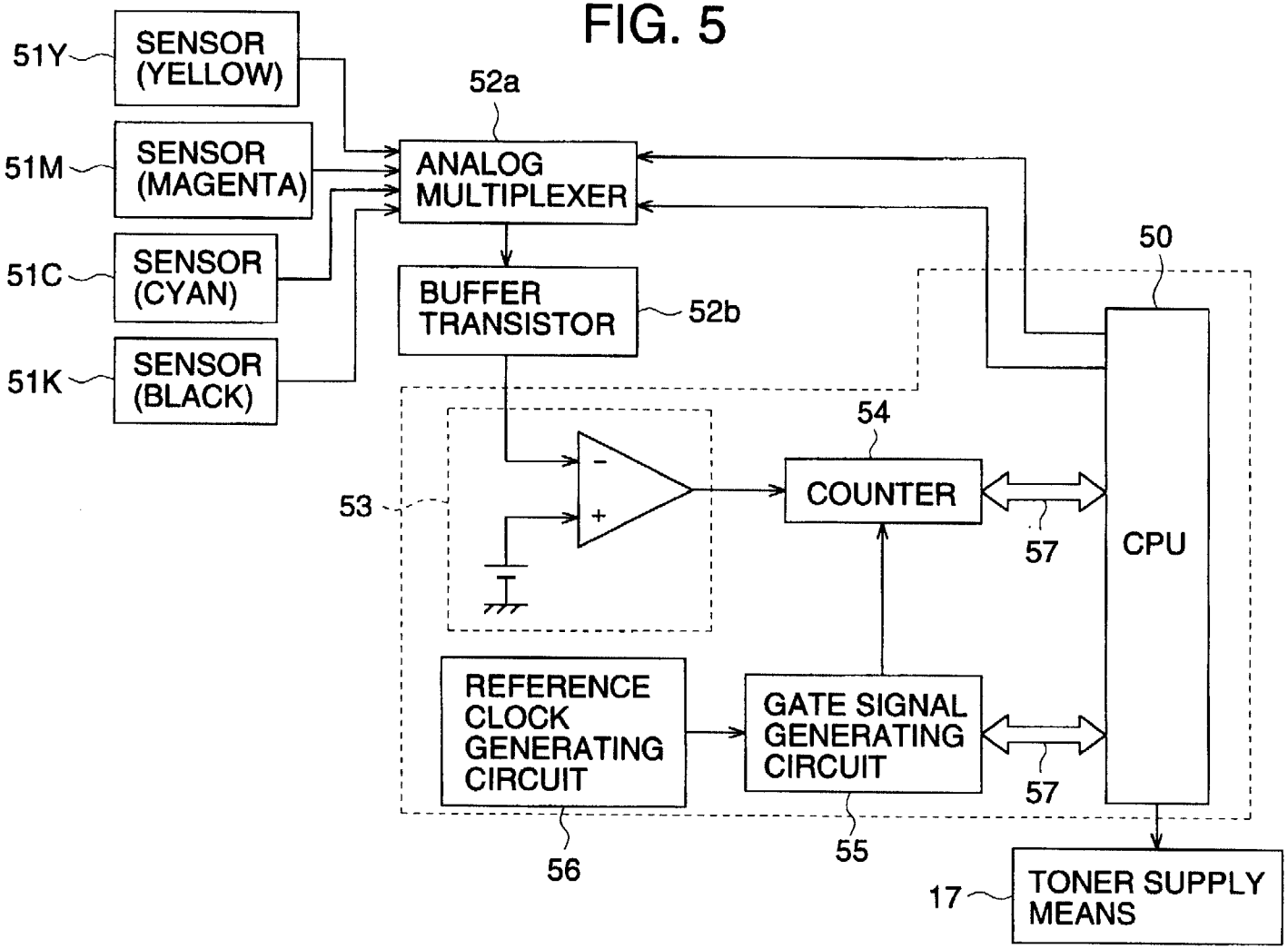
FIG. 5 is a block diagram showing a circuit for detecting toner concentration.

FIG. 5 is a block diagram showing an example of the toner concentration detection circuit. In FIG. 5, **52*b* is a buffer transistor, 53 is a waveform shaper composed of a comparator, 54 is a 16-bit counter, 55 is a gate signal generating circuit composed of an input of a clock from standard clock generating circuit 56 wherein a crystal oscillator is used and of 16-bit counter, and the counter 54 and the gate signal generating circuit 55 are connected to CPU 50 respectively through bus line 57**.

One of output from toner concentration sensors 51Y, 51M, 51C and 51K is selected by analog multiplexer **52*a*, and is inputted in waveform shaper 53 through the buffer transistor 52*b*. This input signal is shaped by waveform shaper 53 to be rectangular pulse waveform, and is inputted in the counter 54. In the counter 54, the number of pulses within a certain period of time such as 100 msec is counted through gate signals sent out by gate signal generating circuit 55. This counted value (digital value) is inputted in CPU 50 immediately. The value thus inputted (the value corresponding to oscillation frequency of the sensor) is compared with the reference value (reference frequency) stored in a memory in CPU 50, and toner supply signals are outputted to toner supply means 17 in accordance with a difference obtained from the above comparison. This process is conducted in succession of Y.M.C and K through signal selection made by analog multiplexer 52*a*. Thereby, toner is supplied to each developer of developing unit 14**.

Buffer transistor **52*b* in a toner concentration detection circuit shown in FIG. 5 may either be eliminated or be incorporated in an output section on each of 51Y, 51M, 51C and 51K** sensors.

Figure 6:
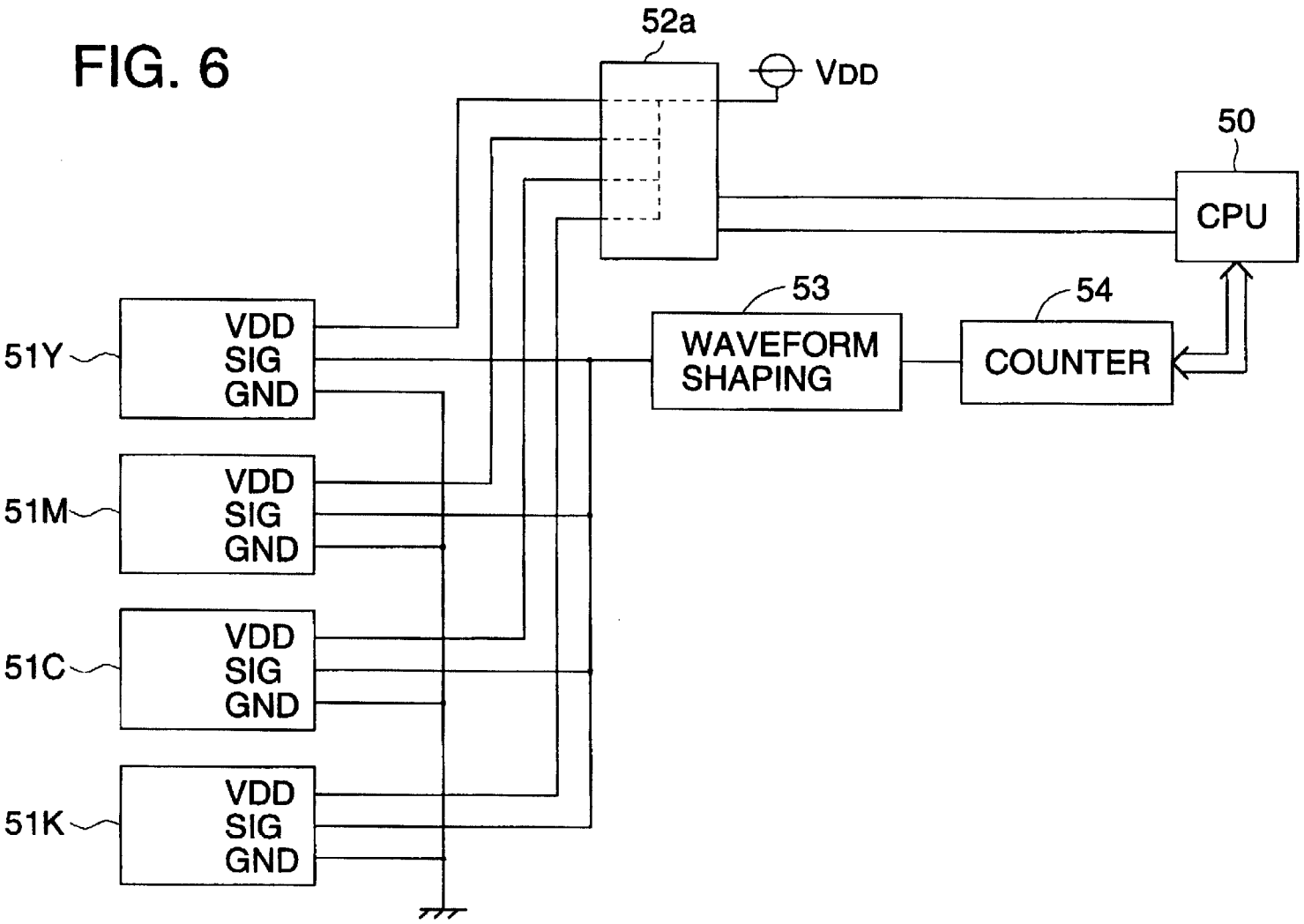
FIG. 6 is a block diagram showing another circuit for detecting toner concentration.

As a method to switch a signal of each sensor 51Y, 51M, 51C or 51K, a circuit shown in FIG. 6 may be used. In FIG. 6, a buffer transistor is built in the sensor, and $V_{DD}$ is a power supply for the sensor, and it is a power supply of DC+5V, for example. SIG is sensor output signal which is outputted with a waveform that is mostly a sine wave of 200 kHz. GND is a ground for the sensor. A method for switching a signal of each sensor 51Y, 51M, 51C or 51K is one wherein power supply $V_{DD}$ to be impressed on each sensor 51Y, 51M, 51C or 51K is switched by analog multiplexer **52*a***. In this case, only one sensor is always on the oscillation state, and therefore, interference of signals between sensors can be prevented, which is a merit.

Incidentally, when a multiplication circuit that multiplies pulse frequency is inserted between waveform shaper 53 having the aforesaid constitution and counter 54 and apparent frequency is increased, it is possible to lessen an amount of change of toner concentration per 1 increased pulse and thereby to improve the detection accuracy.

By means of the developing unit 14 explained above, development is conducted by developing sleeve 141 for the first color (yellow, for example).

Between photoreceptor drum 10 and developing sleeve 141, A.C. bias voltage $V_{AC}$ and D.C. bias voltage $V_{DC}$ are impressed so that they are super imposed each other. In this case, when voltage $V_{DC}$ of D.C. bias is established to satisfy the relation of $V_H>V_{DC}>V_L$ wherein $V_L$ represents potential (ground potential) of an exposed portion on the photoreceptor drum 10 and $V_H$ represents surface potential of a charged light-sensitive layer other than the exposed portion, toner urged by A.C. bias $V_{AC}$ to leave carrier does not stick to the portion whose potential $V_H$ is higher than $V_{DC}$ but sticks to the portion whose potential $V_L$ is lower than $V_{DC}$ to visualize images for development.

After completion of the development for the first color, an image forming process for the second color (magenta, for example) is started, and photoreceptor drum 10 is charged evenly grain and a latent image based on the image data for the second color is formed by imagewise exposure means 13. For the third color (cyan) and the fourth color (black), the image forming process identical to that for the first color is conducted, thus developments for four colors in total are conducted on the circumferential surface of the photoreceptor drum 10.

On the other hand, recording sheet P fed by sheet-feeding mechanism 22 from sheet-feed cassette 21 is conveyed by transfer belt unit 30 on which transfer belt 31 is mounted to nip portion (transfer area) 35 formed between photoreceptor drum 10 and transfer belt 31 where the multi-color image on the circumferential surface of the photoreceptor drum 10 is transferred all together onto recording paper P. In this case, high voltage is impressed on shaft **32*a* of holding roller 32** at the upstream side on the transfer belt 31, and conductive brush 34 provided at the position facing the shaft 32*a* through the transfer belt 31 is grounded, thus the recording sheet fed enters between the brush 34 and the transfer belt 31, and it further advances to the transfer area while being attracted to the transfer belt 31 by charged poured in the recording sheet P by the brush 34.

The recording sheet P separated from the photoreceptor drum 10 is separated from the transfer belt 31 while being neutralized with an opponent electrode of shaft 32*a* of the holding roller 32 at the downstream side on which the transfer belt 31 is mounted. Toner sticking to the transfer belt 31 is removed by cleaning blade 37. Incidentally, in the course of forming a multi-color image, the transfer belt 31 is kept away from the photoreceptor drum 10 with shaft 33*a* of holding roller 33 at the downstream side serving as a fulcrum.

The recording sheet P separated from the transfer belt unit 30 is conveyed to fixing unit 23 consisting of fixing roller 23*a* and pressure roller 23*b* having therein a heater, where heat and pressure are applied on the recording sheet located between the fixing roller 23*a* and the pressure roller 23*b*, thus sticking toner is fused and fixed on the recording sheet P which is then ejected from the apparatus.

Toner remaining on the circumferential surface of the photoreceptor drum 10 after transferring is neutralized by neutralizing unit 15 and then is conveyed to cleaning unit 16 where the toner is scraped by cleaning blade 16*a* that is in contact with photoreceptor drum 10 to fall into the cleaning unit 16 to be conveyed by a screw and stored in a collection box. The photoreceptor drum 10 from which the residual toner is removed by the cleaning unit 16 is subjected to exposure made by neutralizing unit 11 and then is charged evenly by charging unit 12 to enter the following image forming cycle. When the recording sheet is wound around the photoreceptor drum 10 without being separated from the transfer belt 31 and goes upward beyond the neutralizing unit 15, the cleaning blade 16 and a corona wire may be damaged. Therefore, jam sensor 36 that detects the recording sheet P wound around the drum is provided in the vicinity of the neutralizing unit 15.

Incidentally, in addition to sheet-feed cassette 21 in incorporated in the main body of an apparatus, optional sheet-feed cassette 48 is prepared so that it may be either mounted on or dismounted from the lower portion of apparatus main body 1. When the sheet-feed cassette 48 is mounted, sheet-feeding from the sheet-feed cassette 48 is carried out through a sheet-feed path in the sheet-feed cassette 21 located at the upper portion of the apparatus. On the rear side of the apparatus main body 1, there is provided connector 2 through which the optional sheet-feed cassette 48 is connected to the power supply. Further, on the top of the apparatus main body 1, there are provided power switch 3 and display section 4 on which various messages are displayed.

The laser printer described above is structured so that plural detachable process units may be mounted on apparatus main body 1 thereof.

In FIG. 1, there are provided various units including drum unit A composed of the photoreceptor drum 10, neutralizing unit 15 and cleaning unit 16, developing unit B equipped integrally with developing units for colors of yellow, magenta and cyan, developing unit for black C composed of only a developing unit for black, transfer conveyance unit D composed of transfer unit 30 equipped with transfer belt 31, holding rollers 32 and 33 and cleaning blade 16*a*, and fixing unit E composed of fixing unit 23 consisting of pressure rollers.

Each of units A–E is connected electrically with the main body through a connector, and driving of rotary members equipped on each of units A–E is conducted through transmission of driving force of a motor mounted on the main body to the rotary member through gears.

Figure 7:
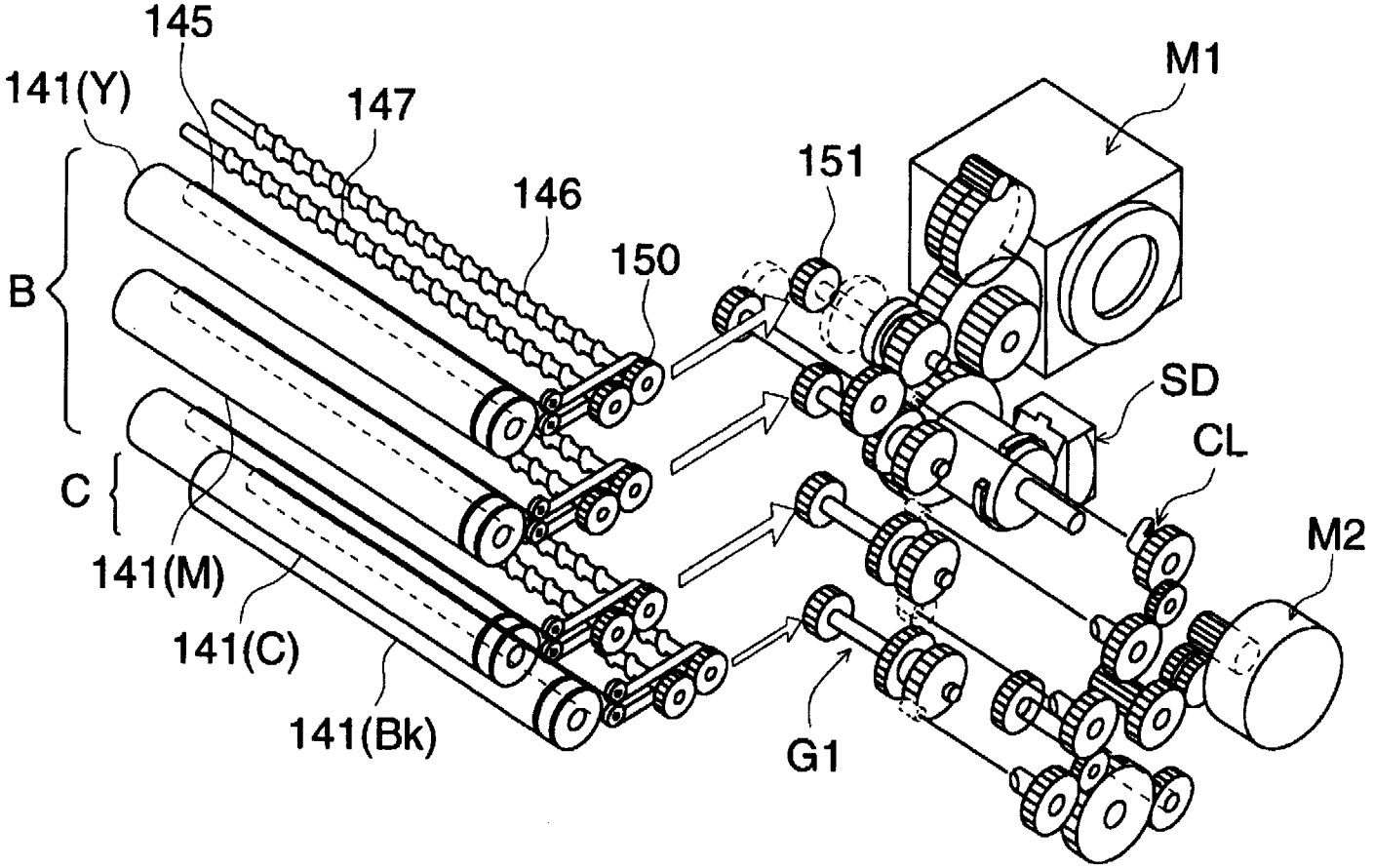
FIG. 7 is a perspective view showing how a developing unit is driven.

FIG. 7 is a perspective view showing the constitution for power transmission between developing units B–C and the main body.

In FIG. 7, power from the main body is transmitted to driven gear 150 supported on the end of stirring screw 146 of developing unit 14, and rotation of the driven gear 150 is then transmitted to stirring screw 147, supply roller 145 and developing sleeve 141, thus stirring screws 146 and 147, supply roller 145, developing sleeve 141 (stirring roller 148) which are rotary members in developing units B and C are driven to rotate. On the main body side, there are provided gear train G1 structured to include driving gear 151 engaged with the aforementioned driven gear 150, development driving motor M1 and development control motor M2, so that a predetermined gear is selectively engaged with clutch mechanism CL and is fixed by controlling a rotation position of clutch mechanism C formed to engage freely with a specific gear with the development control motor M2, and thereby power of rotation of the development driving motor M1 is transmitted to specific developing unit 14 through the gear train G1.

In FIG. 7, SD represents a toner supply switch, and when a toner concentration drop is detected by the toner concentration sensor 51, the toner supply switch SD is turned ON and the development control motor M2 drives, for toner supply, a conveyance screw which conveys toner having the same color as that in the development.

Figure 8:
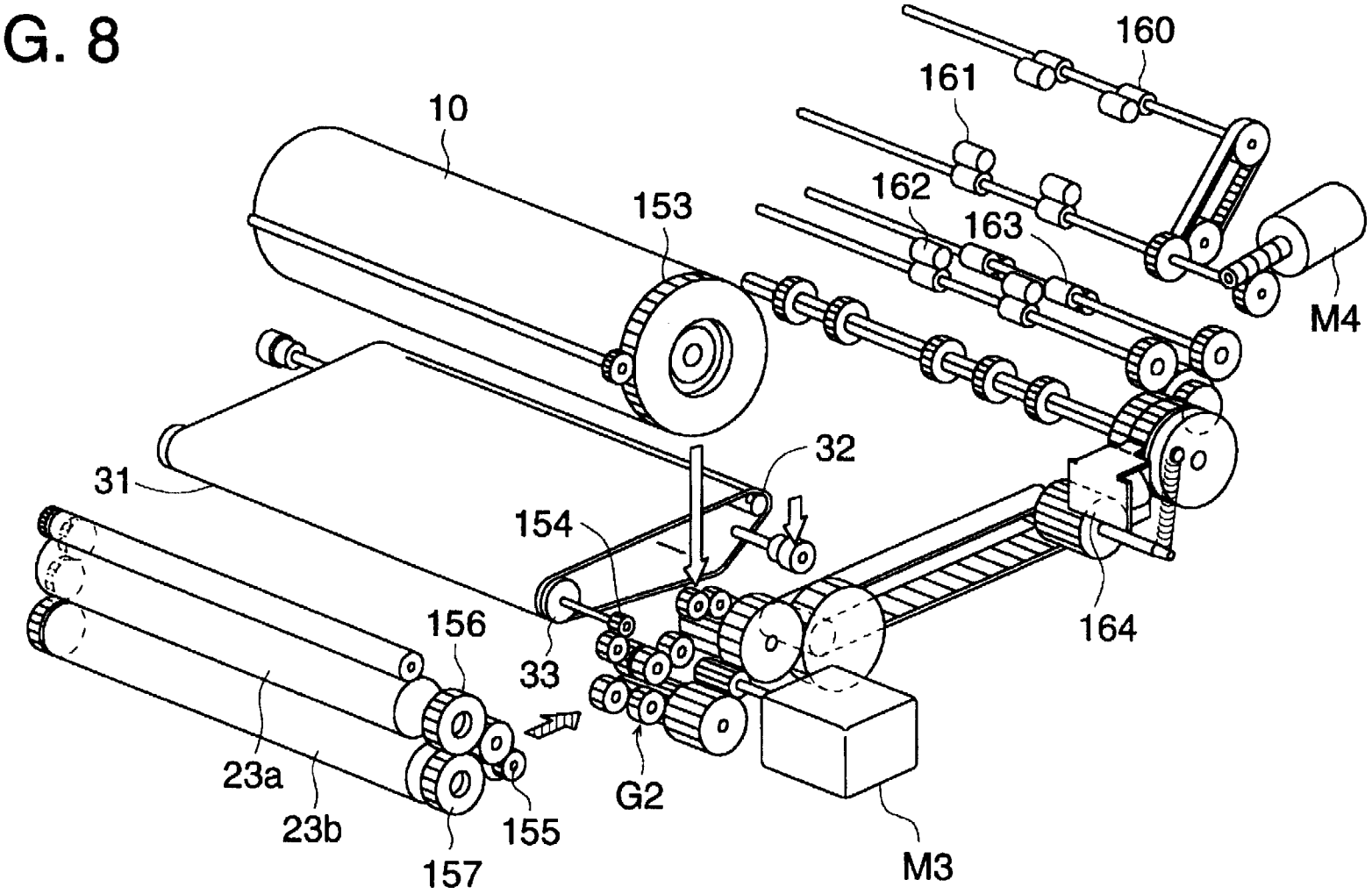
FIG. 8 is a perspective view showing the driving mechanism of the drum, pressure roller and conveyance belt.

In the same manner as in the foregoing, transmission driving power between the main body and a group of drum unit A, transfer conveyance unit D and fixing unit E is conducted through the structure shown in FIG. 8.

In FIG. 8, a powered rotation of main motor M3 provided on the main body is reduced to an appropriate speed for each unit through gear train G2, and this reduced powered rotation is transmitted to each rotary member through engagement of a driven gear supported on a coaxial basis with the rotary member of each unit and an output gear of the gear train G2.

To be concrete, gear 153 is formed on the periphery at one end of photoreceptor drum 10, and when drum unit A is mounted, the gear 153 formed on the photoreceptor drum 10 is engaged with a predetermined output gear of the gear train G2, thus, the powered rotation of motor M3 can be transmitted.

In the same manner as in the foregoing, when transfer conveyance unit D is mounted, gear 154 supported on a shaft of roller 33 for conveyance belt 31 is engaged with a predetermined output gear in the gear train G2, thus, the powered rotation of motor M3 can be transmitted.

Further, when fixing unit E is mounted, gear 155 coupled with gear 156 supported on a coaxial basis with upper roller 23*a* among rollers 23*a* and 23*b* is engaged with a predetermined output gear of the gear train G2, thus, the powered rotation of motor M3 can be transmitted. On the lower roller 23*b*, there is supported gear 157 that engages with the gear 156, and when the upper roller 23*a* is rotated by the transmitted powered rotation of motor M3, the lower roller 23*b* is rotated accordingly.

In the present example, a heater is incorporated only in the lower pressure roller 23*b*, while upper fixing roller 23*a* that is in pressure contact with the lower pressure roller 23*b* is heated by heat conduction through a pressure contact portion between both rollers. In addition, both roller 23a and roller 23b are equipped independently with a temperature sensor (not illustrated) that detects roller temperature (fixing temperature), and an operation of the heater is controlled based on the roller temperature (fixing temperature) detected by the temperature sensor.

Incidentally, in FIG. 8, the numerals 160 and 161 represent sheet-feed rollers for by-pass feeding which are driven by motor M4 which is for exclusive use. Further, the numerals 162 and 163 represent sheet-feed rollers for feeding sheets from sheet-feed cassettes, and powered rotation of the motor M3 is selectively transmitted to the sheet-feed rollers in accordance with ON/OFF of sheet-feed switch 164.

As stated above, each process unit such as drum unit A, color developing unit B, black developing unit C, transfer conveyance unit D or fixing unit E is capable of being mounted on and dismounted from the main body, and is equipped with each of various rotary members driven from the main body side (photoreceptor drum 10, stirring screw 146, conveyance belt 31, roller 23 and others) to which the powered rotation is transmitted through engagement of gears.

For installation of each unit on the main body 1, therefore, when gears transmitting the power are engaged imperfectly, or when foreign materials are caught between gears in the engagement section, or an apparatus is operated without noticing such mechanical abnormality, there are caused damage, wear and deformation of driving parts such as gears, or there is brought a fear that an excessive load is applied on the driving side to cause damage of the driving motor.

There is further a fear that a defective unit wherein foreign materials enter to interfere with rotation of rotary members is mounted by mistake. Even in this case, there is a possibility that damage of parts in the driving system is caused.

In the laser color printer in the present example, therefore, occurrence of mechanical abnormality in the driving system is discriminated by detecting whether rotary members equipped on units are properly driven to rotate or not, to prevent that an apparatus is operated without noticing the abnormality and parts in the driving system are damaged.

First, how abnormality of rotation of rotary members in developing units B and C is detected will be explained as follows.

On the developing units B and C, stirring screws 146 and 147 (stirring members) are driven to rotate from the main body side, and two-component developer is stirred and mixed by the rotation of the stirring screws 146 and 147. In this case, in order to detect toner density on a quick response basis, it is preferable to provide toner concentration sensor 51 in the vicinity of stirring screws as shown in FIG. 2. In such a case, however, concentration detection signals sometimes fluctuate in synchronization with rotation of the stirring screws as shown in FIG. 4, and therefore, a peak value of such fluctuation is used as a detected value in the concentration detection.

From the characteristics mentioned above, on the other hand, it is possible to estimate the state of rotation of the stirring screws based on the fluctuation of the concentration detection signals. In the constitution of the present example, therefore, a control CPU provided on the main body side can discriminate constantly, based on results of detection by toner concentration sensor 51 provided for the purpose of toner supply control, the rotation abnormality of the stirring screws for each developing unit in its drive control condition as shown by a flow chart in FIG. 9.

Figure 9:
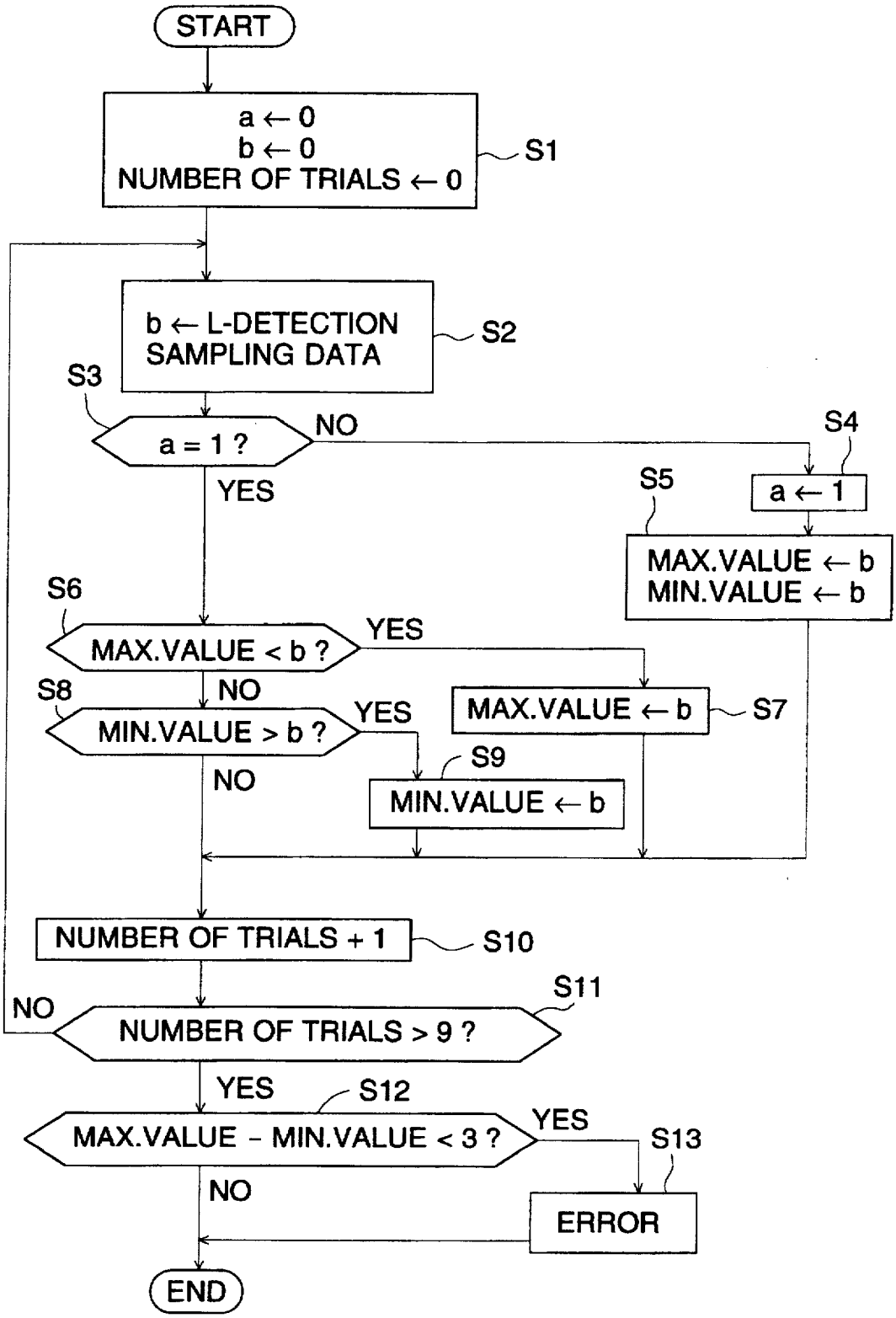
FIG. 9 is a flow chart showing discrimination of rotation abnormality of a stirring screw.
Figure 10:
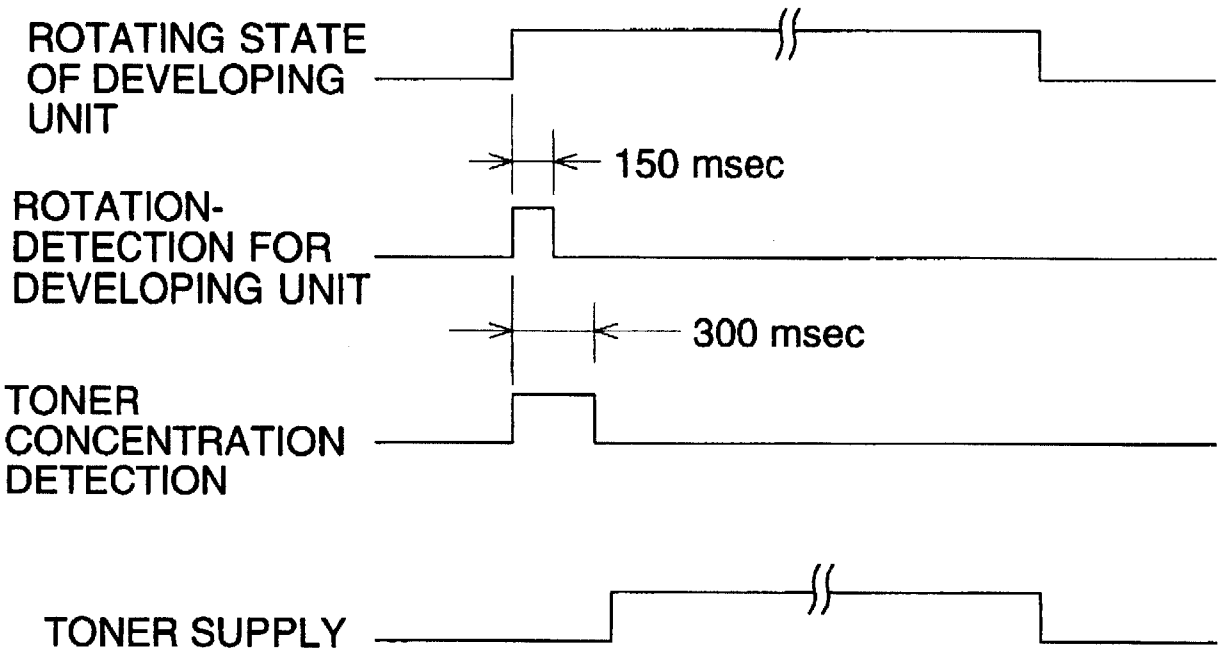
FIGS. 10(A)–10(D) are timing charts showing timing of detection of rotation abnormality.

Now, in the present example, a function as a rotation-detecting means is realized by toner concentration sensor 51 and a software function of CPU shown on a flow chart in FIG. 9, and a function as a rotation abnormality discriminating means is realized by a software function of CPU shown on a flow chart in FIG. 9.

On a flow chart in FIG. 9, parameters a and b for the number of trials to be done are reset to 0 in S1 as an initial setting, first.

In S2, output (the number of pulses within a prescribed period of time corresponding to the oscillation frequency) of concentration sensor 51 equipped on developing unit 14 in operation sampled every 15 msec for the toner supply control mentioned above is read and it is set to b. Namely, the detected value of toner concentration sampled for toner supply is also used for detection of rotation abnormality of the stirring member in the constitution.

In S3, rotation abnormality can be discriminated whether it is the first discrimination or not by discriminating a whether it is zero or not. Since the aforementioned A is reset to zero in the initial setting of S1, when it advances to S3, discrimination is made to be a=0 and it advances to s4.

In S4, 1 is set to A so that an advancement is made from S3 to S6.

In S5, the aforementioned b, namely sampling data in the first occasion is set to the maximum value and the minimum value of the sensor output.

In S10, the number of trials is increased by 1, and in S11, it is discriminated whether the number of trials exceeds the predetermined value (e.g., 9) or not.

When the number of trials does not exceed the predetermined value, the sequence returns to S2 to sample the toner concentration newly to set it to b.

On the second occasion and thereafter, the sequence advances in the order of S2→S3→S6, and in S6, it is discriminated whether sampling data b this time exceeds the maximum value to that moment or not. When the sensor output exceeding the maximum value is sampled, the sequence advances to S7 where the sampling data this time is set to the maximum value so that the maximum value can be updated each time greater sensor output is sampled.

In the same manner as in the foregoing, in S8, the minimum value is compared with the sampling data this time, and when the sensor output that is lower than the minimum value to that moment is sampled, the sequence advances to S9 and the updated minimum value is established.

In the manner stated above, sensor output sampled newly is compared with the maximum value and the minimum value, and process to establish the updated maximum value and the minimum value is repeated for the predetermined times. When the number of trials exceeds the predetermined times of processes, the sequence advances to S12.

In S12, there is obtained a deflection between the maximum value and the minimum value within sensor output obtained from samplings in the aforementioned predetermined times, and it is discriminated whether the deflection is lower than the prescribed value or not.

In this case, when stirring screw 147 is rotating regularly, fluctuation of sensor output is caused in synchronization with the rotation of the screw 147 as shown in FIG. 4 and thereby the deflection reaches the prescribed value or higher. Therefore, when the deflection is discriminated to be lower than the prescribed value, the stirring screw 147 is assumed to be driven to rotate, from a viewpoint of control. However, the stirring screw is not rotating at all or is rotating at the speed lower than the expected speed actually. Therefore, it is presumed that the fluctuation range of sensor output is smaller compared with one in the normal occasion.

Accordingly, when the aforementioned deflection is lower than the prescribed value in S12, the sequence advances to S13 and it is judged that rotation abnormality is caused on the stirring screw 147 in the developing unit.

Incidentally, each step to obtain the maximum value and the minimum value from toner concentration sampled within a prescribed period of time corresponds to the rotation-detecting means and a step to discriminate rotation abnormality based on a deflection of the maximum value and the minimum value corresponds to the rotation abnormality discriminating means.

When a judgment is made for the rotation abnormality mentioned above, rotation of developing unit 14 driven by a motor is stopped immediately, and an apparatus is made to be on the state of standby (driving mechanism stopping means). Thereby, it is possible to prevent that the developing unit 14 is driven while mechanical abnormality occurs in the driving system, resulting in damage of parts in the driving system. In addition, since the rotation abnormality detection mentioned above is made to be conducted for each print constantly, driving is stopped immediately even in the case that mechanical abnormality disturbing rotation of stirring screws in the developing unit 14 after installation of the unit takes place, without being limited to mechanical abnormality in driving power transmitting system caused by improper installation, resulting in protection of parts in the driving system.

Further, occurrence of rotation abnormality of stirring screws in the developing unit 14 or occurrence of improper installation of the developing unit are displayed on the display section 4 mentioned above, or remounting and inspection of the developing unit are displayed (abnormality display means) so that users and workers for maintenance and inspection may use the developing unit for appropriate processing.

Thereby, users and workers for maintenance and inspection can easily conduct maintenance of defective portions, and easy operation can be achieved.

In the constitution of the example mentioned above, rotation abnormality of rotary members such as stirring screws of the developing unit is detected based on the results of detection made by toner concentration sensor 51 provided for controlling toner supply. Therefore, it is not necessary to install an exclusive sensor additionally for detection of rotation abnormality, and it is possible to prevent that the apparatus is complicated to cause an considerable cost increase.

In this case, it is preferable that the detection of rotation abnormality is completed in a short period of time because if it takes a long time to detect the rotation abnormality, parts in the driving system such as gears are damaged during the detecting period. When erroneous detections are made, however, reliability of the apparatus is lost. Therefore, it is desired that detection of rotation abnormality is made in a period that is as short as possible while detection accuracy is kept. For example, it is preferable that sampling of detection value of toner concentration for abnormal rotation is made within a time period (e.g., 150 msec) that is about a half of the concentration detecting time, when detection of toner concentration is made within a time (e.g., 300 msec) that is slightly longer than the rotation period (e.g., 250 msec) of the stirring screw (FIGS. 10(A)–10(D)). For the detection of rotation abnormality based on the fluctuation range of the toner concentration mentioned above, it is not always necessary to obtain the peak value of toner concentration, which therefore makes it possible to detect within a time that is shorter than the predetermined fluctuation cycle as stated above.

Though the above-mentioned example has the constitution wherein rotation abnormality of the stirring screw is discriminated based on the fact that the fluctuation range of toner concentration is smaller than a predetermined value, there may also be employed the constitution wherein rotation abnormality of the stirring screw is discriminated based on the fluctuation cycle of the toner concentration detection values, because the fluctuation cycle of the toner concentration detection values corresponds to the rotation cycle of the stirring screw as stated above.

Namely, the maximum value and the minimum value of sensor output are obtained as shown on a flow chart in FIG. 9, and concurrently with that, timing with which the maximum value and the minimum value are sampled is stored, and a fluctuation cycle of sensor output (toner concentration) is obtained as a difference between timing for sampling of the maximum value and that of the minimum value, and when the fluctuation cycle is longer than a cycle corresponding to the predetermined rotating speed of the stirring screw, the stirring screw that is suspended is discriminated or occurrence of the state of abnormal rotation which is slower than the predetermined speed is discriminated.

When abnormality that a speed of revolution is too slow takes place in this case, the toner concentration fluctuation cycle changes to its longer side. Therefore, a period of time for detecting the aforementioned fluctuation cycle needs to be longer than at least the regular rotating cycle of the stirring screw. From the viewpoint of quick detection, therefore, detection of rotation abnormality by means of the above-mentioned fluctuation range is more preferable.

Further, in the constitution of the above example, a toner concentration sensor which detects toner concentration based on the magnetic permeability of a developer is used. This, however, does not limit the constitution of the toner concentration sensor, and, for example, a sensor that detects toner concentration based on light reflectance in a developer may be used.

Figure 14:
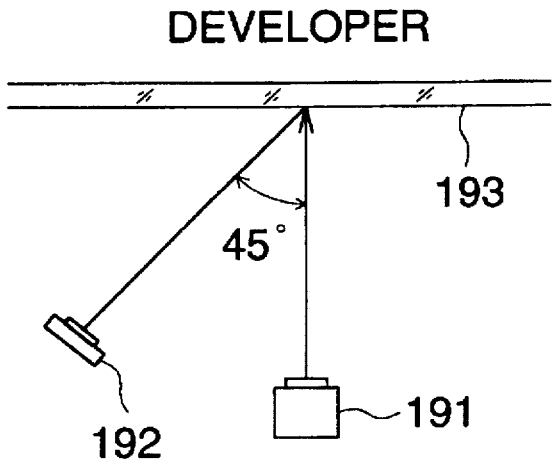
FIG. 14 is a front view showing how the optics toner concentration sensor is structured.
Figure 15:
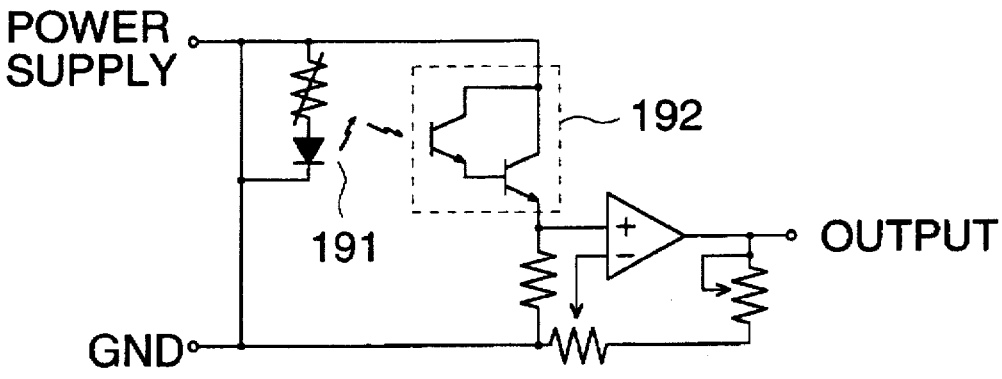
FIG. 15 is a circuit diagram showing how the circuit of the optics toner concentration sensor is structured.
Figure 16:
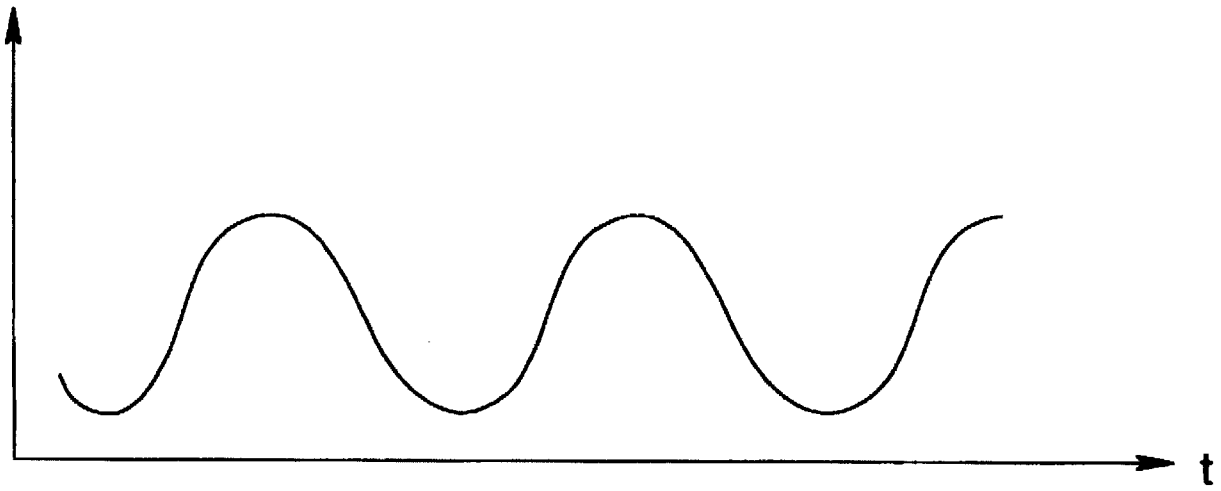
FIG. 16 is a time chart showing output of the optics toner concentration sensor.

The toner concentration sensor of an optics type is composed of LED 191 that is a light-emitting element and phototransistor 192 that is a light-receiving element as shown in FIGS. 14 and 15, for example, and light of LED 191 is projected on the glass plate from the inner portion of the sensor formed by the container of developer and glass plate 193 at with an incident angle that is almost 90°, then light reflected on developer transmitted through the glass plate 193 is made to enter the phototransistor 192 provided with an angle of 45° to an axis of incident light, for example, and thereby the toner concentration is detected through reflectance of the developer based on the output of the phototransistor 192. Even this type of toner concentration sensor of an optics type is preferably positioned at the same location as that for toner concentration sensor 51 based on the magnetic permeability shown in FIG. 2, and thereby the fluctuation of toner concentration caused by rotation of the stirring member can be detected by output fluctuation of the toner concentration sensor of an optics type as shown in FIG. 16.

Next, detection of rotation abnormality of rollers 23*a* and 23*b* which are rotary members in fixing unit E will be explained as follows.

With regard to fixing rollers 23 in the present example, only the lower pressure roller 23b is equipped with a heater, and the upper fixing roller 23a is heated up through heat conduction from the pressure roller 23b. Each roller is equipped with a fixing temperature sensor for controlling the fixing temperature.

In the aforesaid constitution, when the heater is operated to heat up while the fixing rollers are in the state of suspension and then the fixing rollers are rotated, the temperature of the upper fixing roller 23a having no heater is changed as the fixing rollers rotate. This phenomena is utilized in the present example to discriminate whether rotation abnormality is caused on the fixing rollers 23 or not as explained below.

Incidentally, in the detection of rotation abnormality in fixing unit E explained below, a rotation detection means is realized by the fixing temperature sensor equipped on the roller 23a and CPU software functions, and a rotation abnormality discriminating means is realized by CPU software functions.

Figure 11:
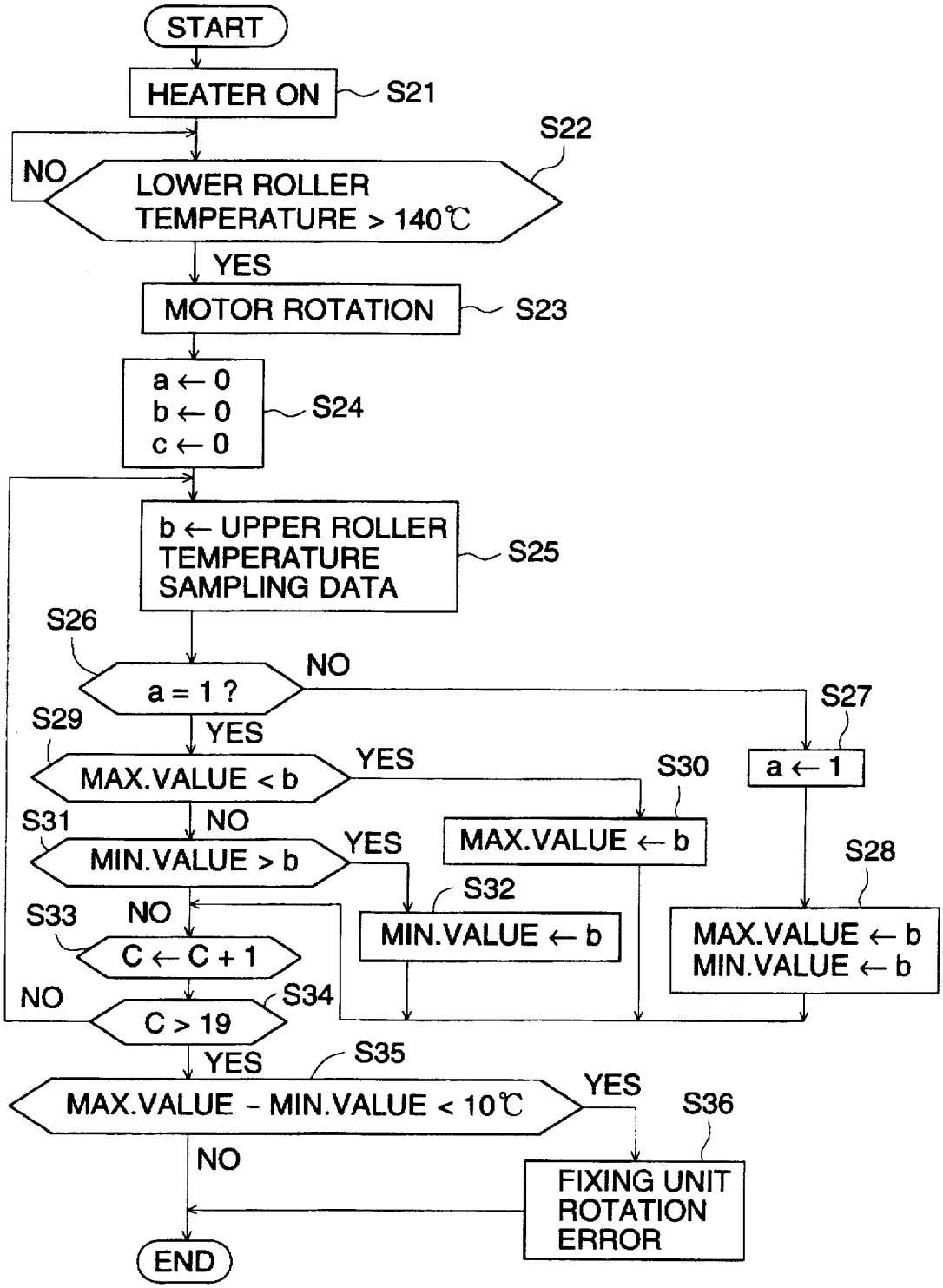
FIG. 11 is a flow chart showing discrimination of rotation abnormality of the pressure roller.

A flow chart in FIG. 11 shows how the rotation abnormality of the rollers 23 is detected actually, and the routine of the rotation abnormality detection shown on the flow chart is executed after the power source is turned on.

First, in S21, supply of power source to the heater equipped on the lower roller 23b is started. In this case, the rollers 23 are not driven to rotate, and only the heater is operated to heat up while the rollers 23 are suspended.

In S22, it is discriminated whether the heater given the power source has caused the temperature of the lower pressure roller 23b to exceed a predetermined temperature (e.g., 140°) or not.

When the temperature of the lower pressure roller 23b exceeds the predetermined temperature, the sequence advances to S23 and a motor provided on the main body side starts driving the rollers 23 to rotate.

In S24, each of parameters a, b and c used for detection of rotation abnormality of the rollers 23 is set to 0.

In S25, the temperature detected by a fixing temperature sensor equipped on the upper roller 23a is read and it is set to b.

In S26, it is discriminated whether a is 1 or not, namely whether it is the first temperature sampling or not, and when a is 0 to show the first sampling, the sequence advances to S27.

In S27, 1 is set to the a, while in S28, first sampling temperature b is set to the maximum value and the minimum value.

In S33, the number of samplings of temperature c is increased by 1, and in S34, it is discriminated whether the number of samplings c exceeds a predetermined number (e.g., 19) or not. When the sequence advances from S28 to S33 and S34, the sequence returns from S34 to S25 because the number of sampling c is 1.

In S25, the temperature of the upper roller 23a is sampled newly, and sequence advances in the manner of S25→S26→S29 because a=1 is set for the second sampling and thereafter.

In S29, the temperature b sampled this time is compared with the maximum value which had been set by the previous occasion, and when the temperature b exceeding the maximum value is sampled, the sequence advances to S30 and the temperature b sampled this time is set to the maximum value.

In the same manner, in S31, the temperature b sampled this time is compared with the minimum value which had been set by the previous occasion, and when the temperature b being lower than the maximum value is sampled, the sequence advances to S32 and the temperature b sampled this time is set to the minimum value.

The sequence advances to S33 for each sampling so that the number of samplings c is counted up, thus, temperature sampling as well as renewal and setting of the maximum and minimum values are repeated until it is discriminated that the number of samplings c exceeds the predetermined number of times in S34.

When the number of samplings of temperature exceeds the predetermined value, the sequence advances to S35 where it is discriminated whether the deflection between the maximum value and the minimum value obtained from sampled temperatures in predetermined number is lower than the predetermined temperature (e.g., 10° C.) or not, namely whether a temperature fluctuation range within a predetermined period of time after fixing rollers 23 are started to be driven for rotation from their state of suspension is lower than the predetermined value or not.

In this case, when the temperature difference between the maximum value and the minimum value is discriminated to be lower than the predetermined temperature, it is assumed that expected temperature fluctuation was not caused because fixing rollers 23 did not rotate at all or they rotated at the speed that is lower than the predetermined speed actually, though they were started to be driven for rotation after the lower roller 23b was heated up to the predetermined temperature. In this case, the sequence advances to S36 where occurrence of rotation abnormality in the fixing rollers 23 is discriminated.

When rotation abnormality in the fixing rollers 23 is discriminated, drive for at least fixing rollers 23 is stopped (means for stopping drive for rotation) similarly to the occasion of occurrence of rotation abnormality in the developing unit, to make the entire apparatus to be on standby and to display the occurrence of rotation abnormality and the instructions for remounting and inspection (abnormality display means).

Owing to the foregoing, it is possible to prevent that driving parts such as gears on the fixing rollers 23 constituting the fixing unit are damaged, and it is possible to make users of an apparatus and workers for maintenance and inspection of the apparatus act appropriately. Further, since output of the temperature sensor used for heater control for the appropriate fixing temperature is read as a parameter for detecting the state of rotation of rollers 23 that are rotary members, it is not necessary to provide an exclusive sensor for detecting rotation abnormality.

Next, detection of rotation abnormality of photoreceptor drum 10 that is a rotary member of drum unit A will be explained as follows.

Detection of rotation abnormality of photoreceptor drum 10 is conducted by the combination (rotation detecting means) of an optics sensor (photomicrosensor) composed of a light-emitting element provided on the main body side and a reflection portion provided along the rotation direction on the flange portion at one end of the photoreceptor drum 10.

Figure 12:
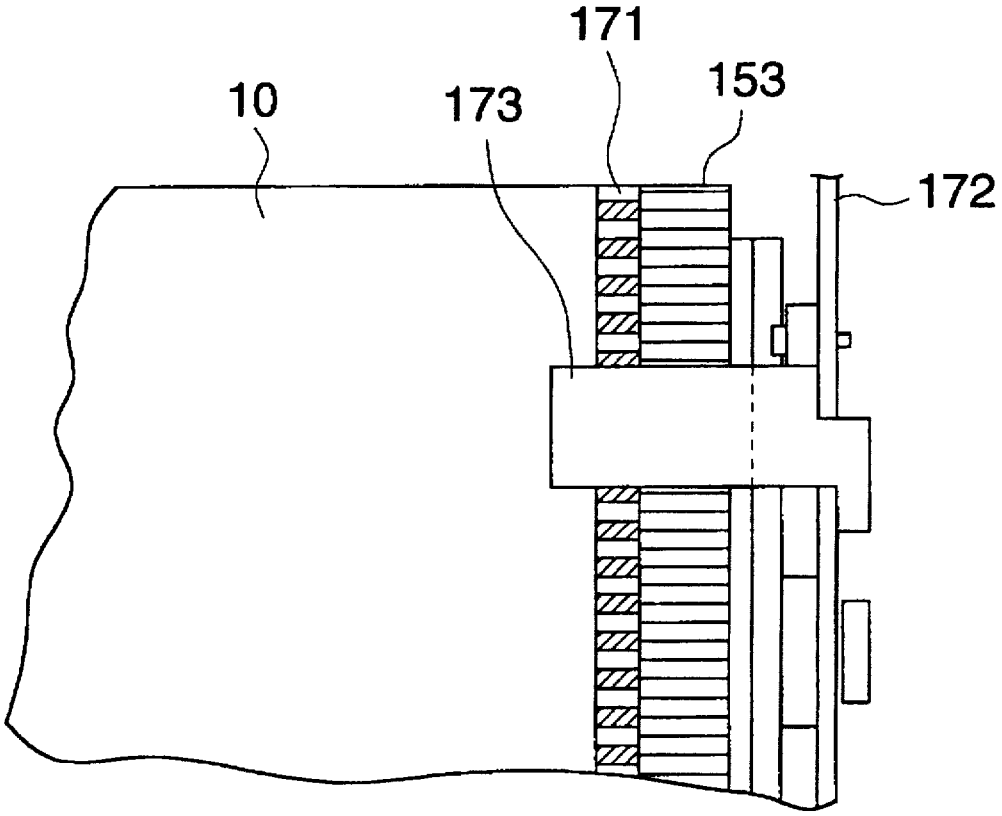
FIG. 12 is a partially-enlarged view showing how the sensor detecting rotation abnormality of a drum is structured.

Namely, as shown in FIG. 12, there are provided reflection portions 171 on a non-image-forming area of a flange at one end of photoreceptor drum 10 so that each of the reflection portions is located next to gear 153 for driving and changes in terms of light reflectance from a high value to a low value at regular intervals along the circumferential surface of the drum.

On the other hand, photomicrosensor 173 wherein an LED (light-emitting element) and a phototransistor are incorporated integrally is supported on main body panel 172 in a way that the photomicrosensor may be located to face the reflection portions with a predetermined distance and therefrom so that light emitted from the LED may be reflected on the reflection portion to enter the phototransistor.

Now, when the photoreceptor drum 10 is rotated, reflectance of the portion on which light from LED is reflected changes periodically. thus, output of the phototransistor fluctuates at a cycle corresponding to the rotating speed of the photoreceptor drum 10.

Therefore, when drum unit A is correctly mounted on the main body, gears on a driving side provided on the main body side is engaged properly with gear 153 provided on the drum 10, and photoreceptor drum 10 is rotated at the regular rotating speed, output of the phototransistor on the photomicrosensor 173 fluctuates at a predetermined cycle corresponding to the regular rotating speed mentioned above.

On the other hand, when the rotating speed of the photoreceptor drum 10 is caused to be abnormal by improper engagement of the aforementioned gears or by foreign materials caught in the engagement area, output of the phototransistor is fluctuated at a cycle that is different from the aforementioned predetermined cycle. Therefore, it can be discriminated whether the photoreceptor drum 10 is driven to rotate regularly or not depending on whether the fluctuation cycle of output of the phototransistor is within a predetermined range or not (rotation abnormality discriminating means).

When the fluctuation cycle of output of the photoresistor is within a predetermined range and rotation abnormality of the photoreceptor drum 10 is discriminated, there is a high possibility that mechanical abnormality such as improper engagement of gears is caused. Therefore, drive for rotation for the photoreceptor drum 10 is stopped immediately, and occurrence of abnormality or instructions for such abnormality is displayed.

Owing to the foregoing, it is possible to prevent that parts in a driving system for the photoreceptor drum are damaged, and it is possible to provide appropriate processing.

It is further possible to detect whether the drum unit A is mounted or not by the use of a sensor wherein the photomicrosensor 173 and reflection portions 171 are combined. Under the state where the drum unit A is not mounted, light emitted from LED of the photomicrosensor 173 advances without being reflected on the photoreceptor drum 10. Therefore, reflected light does not arrive at the phototransistor at all, or it is weakened to be a faint light even if it arrives. Therefore, under the state where the drum unit A is not mounted, output of the phototransistor is extremely lowered compared with an occasion when the drum unit is mounted, thereby it is possible to detect whether the drum unit A is mounted or not.

Therefore, it is possible to detect whether the drum unit A is mounted or not based on output of the phototransistor before the photoreceptor drum 10 is driven to rotate (printing operation) and to prevent that printing operation is conducted when the drum unit A is not mounted, by stopping the movement to printing operation when the drum unit A is not mounted and by warning that the drum unit A is not mounted. Further, even when the drum unit is mounted, if rotation abnormality is detected based on output of the phototransistor when the photoreceptor drum 10 is driven for rotation actually for printing operation, judgment is made to assume that there must be some mechanical abnormality or other if the drum unit is mounted, and driving for rotation (printing operation) is stopped.

As stated above, the use of a sensor wherein the photomicrosensor 173 and reflection portions 171 are combined makes it possible to detect whether drum unit A is mounted or not and to detect rotation abnormality of photoreceptor drum 10 that is a rotary member of the drum unit A. Therefore, it is possible to further simplify the constitution of an apparatus and to achieve further cost reduction, compared with an instance where each exclusive sensor is used for detection.

In the same manner as in the photoreceptor drum 10, it is possible to detect rotation abnormality of conveyance belt 31 that is a rotary member of transfer conveyance unit D.

Figure 13:
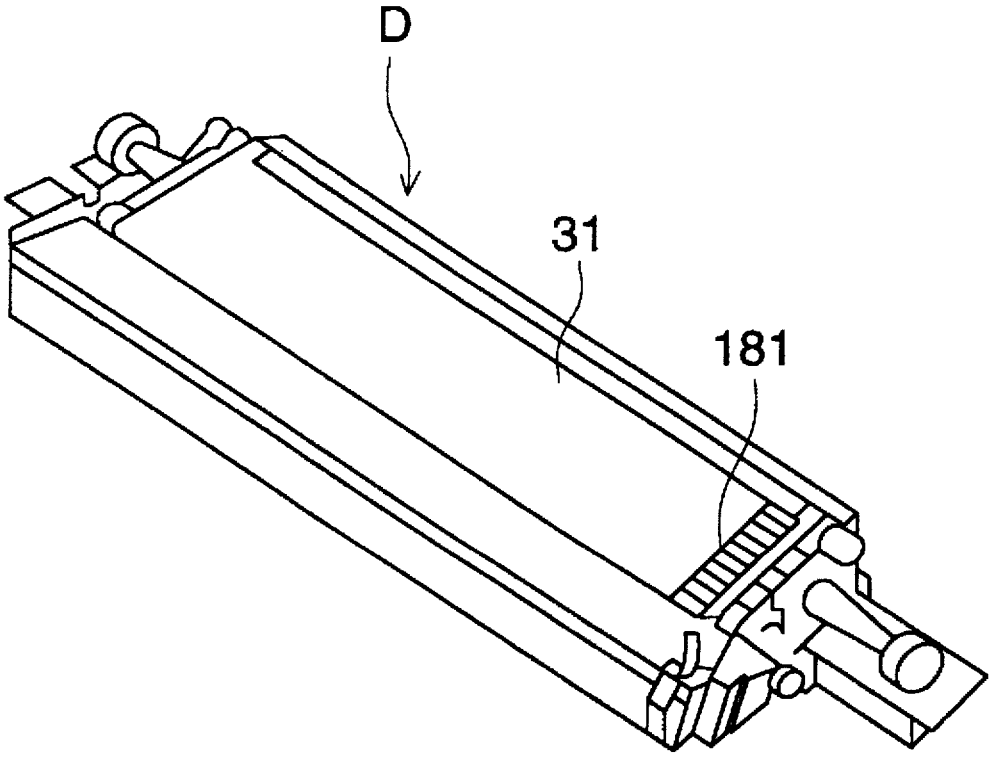
FIG. 13 is a perspective view showing how the sensor detecting rotation abnormality of a conveyance belt is structured.

Namely, as shown in FIG. 13, there are provided reflection portions 181 on a non-image-forming area at one end of conveyance belt 31 so that each of the reflection portions changes in terms of light reflectance to two high and low steps at regular intervals along the advancement direction of the conveyance belt 31, and there is provided a photomicrosensor (not illustrated) wherein an LED (light-emitting element) and a phototransistor are combined integrally at the position where the aforementioned reflection portions 181 can be detected on the main body on which transfer conveyance unit D is mounted.

The reflection portions mentioned above can be constituted in the manner wherein gray portions are formed on a brown conveyance belt, for example, at constant intervals along the advancement direction of the conveyance belt.

Owing to this constitution, the cycle of output of the phototransistor fluctuates corresponding to the rotating speed of the conveyance belt 31. Therefore, it is possible to detect rotation abnormality of the conveyance belt 31 (rotation abnormality discriminating means) by discriminating whether the output cycle in the driven rotation is a value corresponding to the predetermined rotating speed or not.

By stopping the drive for rotation immediately (rotation drive stopping means) when rotation abnormality is detected, it is possible to avoid that an apparatus is operated while some mechanical abnormality or other is caused in the transmission system through which the driving force from the main body is transmitted, and thereby driving parts such as gears are damaged, and it is further possible to make users and workers for maintenance and inspection to take actions appropriately, by displaying the occurrence of abnormality or instructions for coping with such abnormality (abnormality display means).

Even in this case, when transfer conveyance unit D is not mounted, output of the phototransistor is lowered extremely compared with an occasion where the transfer conveyance unit D is mounted. Therefore, it is possible to detect rotation abnormality as well as whether the transfer conveyance unit D is mounted or not.

When cleaning unit 16 included in the drum unit A is separated as an another unit and is constituted to be capable of being mounted on and dismounted from apparatus main body 1 in the above-mentioned example, it is possible to make the combination of the reflection portions provided on a collection roller (e.g., on an end of a roller shaft) and a photomicrosensor provided on the main body side to detect the rotation of the collection roller equipped on the cleaning unit 16 and whether the cleaning unit is mounted or not.

In addition, even for developing units B and C as well as for a fixing unit, it is possible to use the combination of the aforesaid reflection portions and a photomicrosensor. However, there is a possibility that the detection accuracy is lowered by contaminated reflection portions. Therefore, it is preferable that toner concentration sensor 51 and a fixing temperature sensor which are equipped from the beginning are used for detection of rotation abnormality. However, the method to use the aforesaid reflection portions and the photomicrosensor is more excellent than the method employing the toner concentration sensor and the fixing temperature sensor on the point that rotation abnormality can be detected in a short time.

As explained above, the detection abnormality detecting device for use in an image forming apparatus related to the first embodiment of the invention has an effect that in a process unit equipped with rotary members which are capable of being mounted on and dismounted from the main body and are driven from the main body side, rotation abnormality of the rotary members can be detected and thereby improper engagement of driving parts and foreign materials caught in the engagement section, and further the state wherein rotary members are not driven for rotation properly due to the mechanical abnormality such as entrance of foreign materials into the unit, can be detected.

The device related to the second embodiment has an effect that an operation of an apparatus wherein mechanical abnormality is caused can be prevented because the drive of rotary members can be stopped when rotation abnormality is discriminated, and thereby the damage of driving parts can be prevented.

The device related to the third embodiment has an effect that it is possible to make users and workers for maintenance and inspection to take appropriate measures by displaying occurrence of abnormality or instructions for occurrence of abnormality when occurrence of rotation abnormality is detected.

The device related to the fourth embodiment has an effect that it is possible to discriminate rotation abnormality of a stirring member while controlling toner supply by the use of a toner concentration sensor, because of the constitution wherein the rotation of the stirring member in a developing unit containing two-component developer is detected based on the fluctuation of toner concentration caused by rotation of the stirring member.

The device related to the fifth embodiment has an effect that whether a stirring member is driven to rotate properly or not can be discriminated depending on whether fluctuation of toner concentration corresponding to rotation of a stirring member of a developing unit is taking place or not.

The device related to the sixth embodiment has an effect that whether a stirring member is driven to rotate properly or not can be discriminated depending on whether fluctuation of toner concentration corresponding to rotation cycle of a stirring member of a developing unit is taking place or not.

The device related to the seventh embodiment has an effect that it is possible to discriminate occurrence of rotation abnormality of a pressure roller by using the results of detection made by a fixing temperature sensor used for controlling fixing temperature in a fixing unit.

The device related to the eighth embodiment has an effect that it is possible to discriminate occurrence of rotation abnormality of fixing rollers depending on whether or not there are taking place fluctuations of a fixing temperature predicted when fixing rollers are started to be driven to rotate.

The device related to the ninth embodiment has an effect that it is possible to discriminate both rotation abnormality of a rotary member of a process unit and whether or not the process unit is mounted, and that amount-detection functions can be realized with a simple constitution.

The device related to the tenth embodiment has an effect that it is possible to detect both rotation abnormality and whether or not a unit is mounted by detecting a reflection portion provided on a rotary member of the process unit with an optics sensor provided on the main body side.

The device related to the eleventh embodiment has an effect that it is possible to detect both whether or not a drum unit is mounted and rotation abnormality of a photoreceptor drum constituting the drum unit, and further to detect whether or not a transfer and conveyance unit is mounted and rotation abnormality of a conveyance belt constituting a transfer and conveyance unit.

What is claimed is:

1. An image forming apparatus comprising:

(a) a unit provided detachably attachable to said apparatus for forming an image;

(b) a driving source provided inside said apparatus and outside said unit;

(c) transmission for transmitting a driving force from said driving source;

(d) a rotary member inside said unit, said rotary member being rotated by the driving force from said driving source transmitted through said transmission;

(e) a detector adapted to detect a characteristic value indicating an image forming condition of said unit, said detector outputting a signal indicative of said value;

(f) a control for controlling said image forming condition on the basis of said signal from said detector so that said characteristic value is maintained constant; and (g) a judging device for recognizing a rotation abnormality of said rotary member based only on said signal from said detector.

2. The apparatus of claim 1 wherein said detector is inside said unit.

3. The apparatus of claim 1 wherein said unit is a developing unit for storing developer composed of toner particles and carrier particles; said image forming condition is a toner concentration in said developing unit; and said control controls the toner concentration to be within a predetermined range based on said signal detected by said detector.

4. The apparatus of claim 3 wherein said rotary member is a stirring member for stirring and mixing the developer.

5. The apparatus of claim 3 wherein said judging device recognizes occurrence of a rotation abnormality of said rotary member when a fluctuation range of toner concentration in a predetermined period of time is not more than a predetermined value.

6. The apparatus of claim 3 wherein said judging device recognizes occurrence of a rotation abnormality of said rotary member when a cycle of fluctuation of toner concentration is outside a predetermined range.

7. The apparatus of claim 1 further comprising a rotation-driving-stopping mechanism for stopping the rotation of at least said rotary member when it exhibits a rotation abnormality detected by said judging device.

8. The apparatus of claim 1 wherein said detector detects a rotation of said rotary member of said unit and detects whether said unit is mounted.

9. The apparatus of claim 1 wherein a sampling period of time of data for recognizing a rotation abnormality of said rotary member is less than a sampling period of time of data for controlling said image forming condition so as to be within said predetermined range.

10. The apparatus of claim 1 wherein said detector, upon detecting the occurrence of said rotation abnormality, provides an indication thereof.

11. The apparatus of claim 10 wherein said indication is an instruction relating to said abnormality.

12. An image forming apparatus comprising:

(a) a fixing unit detachably attachable to said apparatus for forming an image, said fixing unit being equipped with at least a pair of pressure rollers as a rotary member, (b) a driving source inside said apparatus and outside said unit;

(c) transmission for transmitting a driving force from said driving source;

(d) a rotary member inside said unit, said rotary member being rotated by the driving force from said driving source transmitted through said transmission;

(e) a detector adapted to detect a characteristic value indicating an image forming condition of said unit, said detector reading a fixing temperature in said fixing unit as data indicating the state of rotation of said pressure rollers, said detector outputting a signal indicative of said value;

(f) a control for controlling said image forming condition on the basis of said signal from said detector so that said characteristic value is maintained constant; and (g) a judging device for recognizing a rotation abnormality of said pressure rollers based on said fixing temperature.

13. The apparatus of claim 12 wherein said judging device recognizes occurrence of a rotation abnormality of said pressure rollers when the fluctuation range of said fixing temperature during a predetermined period of time from a start of driving said pressure rollers is not more than a predetermined value.

14. An image forming apparatus comprising:

(a) a unit provided detachably attachable to said apparatus for forming an image;

(b) a driving source provided inside said apparatus and outside said unit;

(c) transmission for transmitting a driving force from said driving source;

(d) a rotary member inside said unit, said rotary member being rotated by the driving force from said driving source transmitted through said transmission;

(e) a detector adapted to detect a characteristic value indicating rotation of said rotary member, whether said unit is mounted, and an image forming condition of said unit, said detector outputting a signal indicative of said value;

(f) a control for controlling said image forming condition on the basis of said signal from said detector so that said characteristic value is maintained constant; and (g) a judging device for recognizing a rotation abnormality of said rotary members based on said signal from said detector, (h) a reflection section, having varying reflectance that is provided around an external circumferential portion of said rotary member in a direction of rotation thereof; and (i) an optics sensor, including a light-emitting element and a light-receiving element, wherein said detector detects a rotation of said rotary member based on a change in intensity of light reflected by said reflection section detected by said optics sensor, and whether said unit is mounted is detected based on said reflected light.

15. The apparatus of claim 14 wherein said unit includes a photoreceptor drum as a rotary member and the reflection section is provided at a side edge portion of said photoreceptor drum.

16. The apparatus of claim 14 wherein said unit is a transfer conveyance unit including a conveyor belt as a rotary member and said reflection section is provided at a side edge portion of said conveyance belt.

* * * * *